US008336346B2

(12) United States Patent
Mah

(10) Patent No.: US 8,336,346 B2
(45) Date of Patent: Dec. 25, 2012

(54) HIGH SECURITY MOVING MASS LOCK SYSTEM

(75) Inventor: Gordon B. J. Mah, San Francisco, CA (US)

(73) Assignee: Gordon B. J. Mah and Yu-Chen Mah Family Trust, Palo Alto, CA (US)

( * ) Notice: Subject to any disclaimer, the term of this patent is extended or adjusted under 35 U.S.C. 154(b) by 0 days.

(21) Appl. No.: 12/859,066

(22) Filed: Aug. 18, 2010

(65) Prior Publication Data

US 2012/0042701 A1 Feb. 23, 2012

(51) Int. Cl.
*E05B 9/04* (2006.01)

(52) U.S. Cl. ..... 70/38 B; 70/38 C; 70/352; 70/373; 70/374; 70/375; 70/387; 70/417; 70/422; 70/493

(58) Field of Classification Search ..... 70/38 B, 70/38 C, 352, 387, 493, 373–375, 358, 419, 70/361, 417, 418, 422
See application file for complete search history.

(56) References Cited

U.S. PATENT DOCUMENTS

| | | | | | |
|---|---|---|---|---|---|
| 227,301 | A | * | 5/1880 | Reinhart | 70/345 |
| 451,110 | A | * | 4/1891 | Doremus | 70/47 |
| 1,060,769 | A | * | 5/1913 | Kohlberger | 70/493 |
| 1,095,431 | A | * | 5/1914 | Sprague | 70/46 |
| 1,390,222 | A | * | 9/1921 | Wise | 70/38 C |
| 1,540,488 | A | * | 6/1925 | Mataloni | 70/38 C |
| 1,597,560 | A | * | 8/1926 | Wise | 70/38 R |
| 1,786,511 | A | * | 12/1930 | Warren | 70/49 |
| 2,024,497 | A | * | 12/1935 | Alberti | 70/210 |
| 2,682,764 | A | * | 7/1954 | Kotab | 70/419 |
| 3,413,831 | A | * | 12/1968 | Crepinsek | 70/358 |
| 3,478,549 | A | | 11/1969 | Schlage | |

(Continued)

FOREIGN PATENT DOCUMENTS

JP 2002-256736 A 9/2002

OTHER PUBLICATIONS

Pulford, G. W. "High-Security Mechanical Locks: An Encyclopedic Reference," Chapter 2—Pin-Tumbler Locks, Section 2.9 Tubular, 2007, Elsevier Academic Press, pp. 137-140.

(Continued)

*Primary Examiner* — Lloyd Gall
(74) *Attorney, Agent, or Firm* — Nixon Peabody LLP; Khaled Shami

(57) ABSTRACT

A lock includes a stationary key mass having a first key mass bore and a keyway, and a movable spring mass including a first spring mass bore. A first spring mass pin is mounted in the first spring mass bore, and a first key mass pin is mounted in the first key mass bore for reciprocation between a locked position immobilizing the spring mass and an unlocked position unconstraining motion in at least one direction. The unlocked position is a function of the presence of a matching key in the keyway. Multiple key mass and spring mass pins can be used, some or all of which can have stepped configurations, and corresponding single-bladed or multi-bladed keys, or multiple keys, can be used. The keys can be straight or curved in any of various planes, or they can be straight but flexible to match curved keyways. Curves can be unidirectional or compound. Relative motion between the key mass and spring mass can be in a plane or along straight line or circular.

34 Claims, 20 Drawing Sheets

U.S. PATENT DOCUMENTS

| | | | | | |
|---|---|---|---|---|---|
| 3,499,302 | A | | 3/1970 | Spain et al. | |
| 3,588,397 | A | * | 6/1971 | Ellefson | 235/382 |
| 3,640,107 | A | * | 2/1972 | Litvin | 70/129 |
| 3,908,417 | A | * | 9/1975 | Beudat | 70/100 |
| 3,952,565 | A | * | 4/1976 | Falk | 70/417 |
| 3,990,281 | A | * | 11/1976 | Meder | 70/493 |
| 4,149,394 | A | * | 4/1979 | Sornes | 70/352 |
| 4,292,824 | A | * | 10/1981 | Keller | 70/373 |
| 4,461,161 | A | * | 7/1984 | Shpigelman | 70/352 |
| 4,535,546 | A | | 8/1985 | Smith | |
| 4,635,455 | A | | 1/1987 | Oliver | |
| 4,977,767 | A | | 12/1990 | Prunbauer | |
| 4,977,768 | A | | 12/1990 | Embry | |
| 5,088,306 | A | | 2/1992 | Field | |
| 5,131,247 | A | * | 7/1992 | Hsu | 70/358 |
| 5,146,770 | A | * | 9/1992 | Yun-Sheng | 70/38 C |
| 5,195,340 | A | | 3/1993 | Huang | |
| 5,205,143 | A | | 4/1993 | Hakkarainen et al. | |
| 5,212,974 | A | * | 5/1993 | Shen | 70/352 |
| 5,469,723 | A | * | 11/1995 | Litwin et al. | 70/107 |
| 5,758,528 | A | | 6/1998 | Gallego | |
| 5,893,284 | A | * | 4/1999 | Hrabal | 70/358 |
| 5,987,940 | A | * | 11/1999 | Chang | 70/38 A |
| 6,173,595 | B1 | * | 1/2001 | Hughes | 70/394 |
| 6,305,198 | B1 | * | 10/2001 | Chastain et al. | 70/40 |
| 6,595,032 | B2 | * | 7/2003 | Lin | 70/352 |
| 6,668,607 | B1 | * | 12/2003 | Huang | 70/375 |
| 6,758,073 | B2 | * | 7/2004 | Yu | 70/358 |
| 7,100,409 | B2 | * | 9/2006 | Chang | 70/493 |
| 7,181,937 | B2 | * | 2/2007 | Keller | 70/338 |
| 7,340,929 | B1 | * | 3/2008 | Christopoulos | 70/358 |
| 7,930,916 | B2 | * | 4/2011 | Tamezane et al. | 70/387 |
| 8,056,380 | B2 | * | 11/2011 | Widen | 70/493 |
| 2001/0018837 | A1 | * | 9/2001 | Imedio Ocana | 70/422 |
| 2004/0226327 | A1 | * | 11/2004 | Chou | 70/358 |
| 2006/0137416 | A1 | * | 6/2006 | Chang | 70/417 |
| 2006/0144104 | A1 | | 7/2006 | Chang | |
| 2008/0105017 | A1 | | 5/2008 | Owens | |
| 2008/0202180 | A1 | | 8/2008 | Eller et al. | |

OTHER PUBLICATIONS

Tobias, M. W., J.D., "Universal Pin Tumbler Lock Decoder," Locks, Safes, and Security, vol. 2, 2nd Edition, Section 4.6.1.2, (2000), Charles C. Thomas Publisher, LTD, pp. 763-765.

Tobias, M. W., J.D., "999 Rapping" and "Picking the Lock," Locks, Safes, and Security, vol. 2, 2nd Edition, Sections 5.3.1.5.1 and 5.3.1.6, (2000), Charles C. Thomas Publisher, LTD, p. 167.

Tobias, M. W., J.D., "High Security Lock Standards and Force Entry: a Primer," (2007), 20 pages; Online: http://download.security.org/forced_entry_2007.pdf.

International Search Report in PCT Application No. PCT/US2011/048156, mailed Apr. 9, 2012.

* cited by examiner

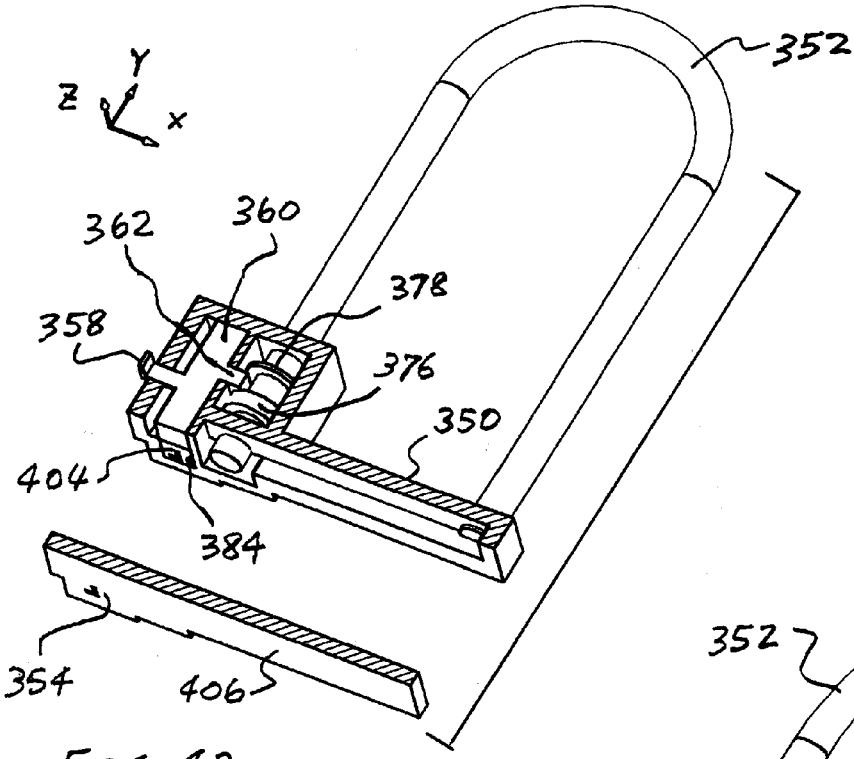
FIG. 43
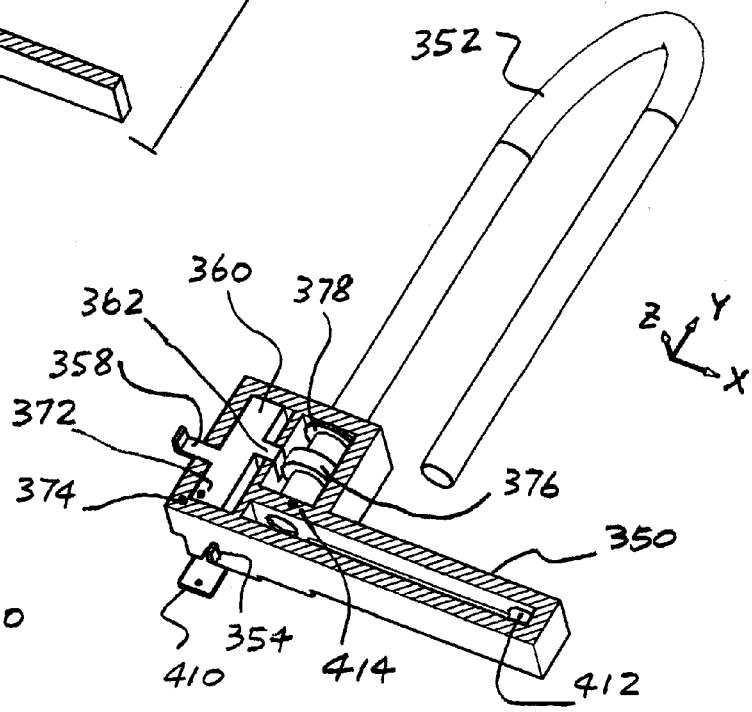
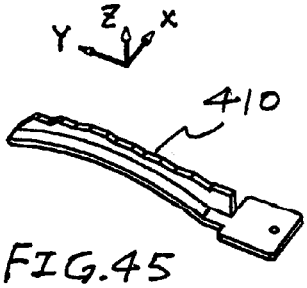
FIG. 45
FIG. 44

HIGH SECURITY MOVING MASS LOCK SYSTEM

TECHNICAL FIELD

The present disclosure relates generally to mechanical locks.

BACKGROUND

In the last few hundred years, the most commonly used mechanical lock systems were developed in several paths, e.g., warded lock, lever lock, and cylinder lock. Among them, the paths of warded lock and lever lock systems have the advantage of protecting the locking mechanism with a strong outer cover against destructive entry. However, they are easier to be bypassed in comparison with a cylinder lock system, which has double detainer pins or wafers. With the double-acting detainer locking principle, the cylinder lock system has been developed and used most extensively because of its high security against bypass. It has been used in wide variety of types of mechanical locks, and dominates the current market.

The basic design of a cylinder lock system has a key cylinder which is mounted rotatably within a cylindrical bore in a housing. A set of detainers (mostly following the double-acting detainer locking principle), e.g., tumbler pins, wafers, et cetera are inserted into the bores of both the key cylinder and its surrounding housing, straddling the shear line (the cylindrical surface or end surface of the cylinder). These detainers prevent the cylinder from rotating about its longitudinal axis, if a correct key is not inserted into the keyway of the cylinder. The insertion of a correct key will move all the detainers to appropriate locations clear of the shear line, freeing the cylinder to rotate through application of a rotational moment to the longitudinal axis of the key, and that of the cylinder. In turn, with or without the help of other connecting mechanical components, the rotating cylinder transmits the action to the bolt or shackle to open the lock. In a sense, the housing is considered a non-mover; and, the key is used to turn the cylinder which is the mover, and to move the bolt or shackle of the lock.

Many methods and tools for lock bypass have been developed. Most commonly used cylinder locks can be bypassed by picking, bumping, impressioning, or decoding. An attacker has at his disposal various tools: pick, pick gun, wire snap pick, "999 rapping key" or bump key, decoder with fine shim wire (such as John Falle's Pin Lock Decoder, globally accepted by law enforcement and intelligence agencies, shim to be inserted between the padlock shackle and the lock body), or other specially designed tools to manipulate and decode locks. The "999 rapping key" is one of the favorite bypass tool because, a single key can be used to open many locks which have the same keyway and pin spacing. Since the "999 rapping keys" can be made inexpensively with recycled keys, criminals can invest very little money to buy just a few of them from many brands of lock to bypass numerous locks. Manufacturers of high security locks counter these bypass attacks with improvements to all components in the cylinder lock system, e.g., mushroom pin, spool pin, serrated pin, long tumbler pin occupying the upright channel, sidebar, rotating pin, telescoping pin, angularly bitted key, laser track on key blade, et cetera. Most improvements have complex design, requiring extremely precise machining, some on tiny parts, and very expensive production.

Furthermore, most cylinder locks, including some high security locks, can be compromised by destructive entry methods, some rather easily. For instance, since the cylinder is the mover, usually it can be shielded only partially from attack by outside force. Using a drill or mill, an attacker can easily destroy the cylinder, pins, wafers, et cetera of many locks by drilling through the keyway, the exposed cylinder, or the shear line. Some cylinders are protected with a small hardened steel pin near the keyway entrance to counter this kind of attack. However, this type of protection is weak in comparison with a strong outer facing. In addition, the commonly used "screw driver and wrench" attack method, described in Marc Weber Tobias, J. D., "Locks, Safes, and Security," Vol. 1 and 2, $2^{nd}$ Edition, 2000, Charles C. Thomas Publisher, LTD., and Marc Weber Tobias, J. D., "High Security Lock Standards and Force Entry: a Primer," http://download.security.org/forced_entry__2007.pdf, can destroy and open easily most locks with cylinder and shell housing design because the attacker has leverage advantage to overcome the resistance. One of the main functions of the cylinder is to be turned by the key and transmit the operational torque to other components of the lock. The attack force to destroy the restrainers (cylinder, pin, wafer, et cetera) enters the lock through the same path used by the operational torque. Therefore, there is no way to avoid or protect the restrainers from an overwhelming attack force. In addition, the complex design of the cylinder to guard against bypass can introduce delicate components and will fail defend against destructive entry attack. In some cases, intricate design requires machining off more material from the cylinder and weakening it as a result. Most high security cylinder locks contain parts which are complicated and machined precisely, some very tiny—for example, the machining of the pin bores, slot in the cylinder for side bar, keyway, housing of the cylinder, et cetera. These requirements steer the production to the use softer metals to make the cylinder and its housing. Unfortunately, the small cylinder, full of bores and with the keyway opened to outside, is the main target of destructive entry such as "screw driver and wrench" attack, drilling, thermal attack, chemical attack, et cetera.

Overview

Described herein is a high security moving mass lock system (MMLS) that is of simple design, easily made, and low cost. The MMLS system offers many novel design ideas and hardware components, which lead to new paths in the design of locks. The MMLS system provides good defenses to both bypass and forced entry attacks. It operates to prevent the freeing of a moving mass, typically referred to herein as the spring mass, to move on a contacted stationary mass, typically referred to herein as the key mass. The movement of the spring mass can be one of the following examples, but not limited to: (1) sliding on a plane, in any direction, (2) rotating, and (3) the combination of the first two. Thus, it can be a movement in one or more degrees of freedom. The contact surface between the key mass and spring mass can be plane or curved surfaces, depending on the desired movement of the moving mass. With more than one degree of freedom to move the moving mass, many possible configurations of the contact surface, and wide variety of shapes of both the moving and stationary masses, locks of the MMLS type can be built in unlimited ways with a range of broader choices of design.

Unlike in conventional mechanical locks, in which torque is applied to rotate the key and provide the force to open the lock, in the MMLS, the key is used only to authenticate that it is the correct key, without the need to transfer force to open the lock. Thus, the key is subjected to only small forces to insert it into, and pull it out of the keyway. The key can thus be made thin, curved, and even flexible; consequently, the keyway can be small and narrow, minimizing the space for bypass attack. Moreover, as the key mass is stationary, the entire mechanism of the lock can be shielded easily behind a strong outer cover with only a small keyway entrance, which can be reinforced locally but heavily.

The MMLS resists both bypass and force entry attacks at the same time with new strategies, which require only simple and inexpensive designs and manufacturing. These include a keyway and key with new types of geometric characteristics to inhibit bypass tools and movements; shielding the lock mechanism with a strong cover; stationary, small, and narrow keyway which can be shielded and reinforced heavily just at its entrance; unpredictable key pin location and size and different contact points with the key bits on the key blade, with the key pins terminating at varying distances from the shear plane, and the termination points may be unaligned with one another; safe activator to limit the attacking forces, and so on. As the result, MMLS has many novel designs and components, which can include curved keyways and keys, flexible key for multi-curvature keyway, ultra tough and/or low melting point metal layer sandwich construction of the masses, stepped pin and pin bore, random spacing of pins, pin bore of random length, and a safe activator. Most of the designs and components provided by MMLS can be used independently, as a function of the specific application, contemplated selling price, manufacturing cost, availability of material and manufacturing capability, the most suitable degree of freedom of the moving mass, and so on. In examples shown later, four locks each built with different degree of freedom of moving mass, various combinations of appropriate designs and components out of the MMLS are used for demonstration. The applications of MMLS locks are myriad, and include doors, steering wheels, cabinets, and so on.

MMLS designs can be used with many types of detainer such as pins and wafers, for example. In addition, the moving mass of the mechanism can be moved in many ways. Thus, the MMLS system opened a new and wide horizon in the design of locks, too much to be covered in one patent. While the description herein is merely of MMLS locks with the moving mass sliding linearly on the stationary key mass, and equipped with only pin type double detainers, locks with mass moving and rotating in other fashions, and using wafer or disc are also contemplated. Also, some of the design ideas and items of MMLS herewith can be used to improve existing lock systems, such as the use of a combination of a stationary key mass and a safe activator.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings:

FIG. 43 is a sectional perspective view of FIG. 38.

FIG. 44 is a perspective sectional view of the bicycle lock in FIG. 38, inserted with the correct key to open the shackle.

FIG. 45 is a perspective view of the correct key of the bicycle lock in FIG. 44.

DESCRIPTION OF EXAMPLE EMBODIMENTS

Example embodiments are described herein in the context of a high security moving mass lock system. Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiments as illustrated in the accompanying drawings. The same reference indicators will be used to the extent possible throughout the drawings and the following description to refer to the same or like items.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
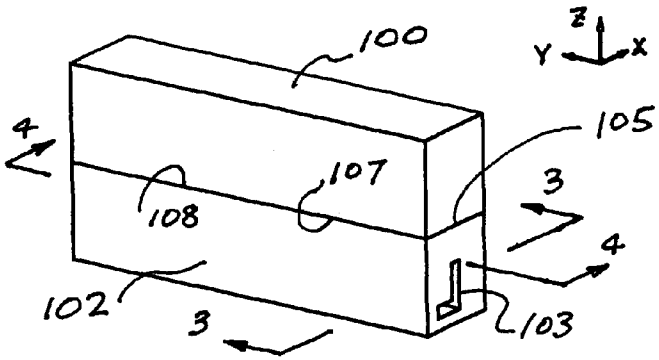
FIG. 1 is a perspective view of a set of a spring mass and a key mass.

FIG. 1 is a schematic diagram showing two basic components of a moving mass locking system (MMLS). These are a spring mass 100 and a key mass 102, which are movable relative to one another, with the key mass typically being stationary and rigidly mounted to the lock body, and the spring mass being movable relative thereto. Spring mass 100 and key mass 102 are shown as having a generally rectangular cuboid shape, for illustration purposes and not by way of limitation. A keyhole 103 in communication with a keyway is provided in one side of key mass 102. Masses 100 and 102 abut each other at respective abutment sides 107 and 108. The interface between these two sides will be referred to as the shear surface, designated 105 in FIG. 1. Shear surface 105 can be one or more plane surfaces, depending on the shape of sides 107 and 108, or it can be a cylindrical or non-cylindrical surface with various directrices, such as circular or elliptical cylindrical surface, or a curved surface, such as a spherical surface, or a compound surface generated by combining plane and curved or cylindrical surfaces.

Key mass 102 is configured to receive a key at keyhole 103 and will typically, but not way of limitation, be rigidly attached to the outer shell of a lock (not shown), or indirectly to a door or the like (not shown). In this manner it can be considered "stationary." Spring mass 100 will typically, but not by way of limitation, contain springs and other components, described below, and is relatively movable with respect to the "stationary" key mass 102 and whatever component (for example the lock shell) the key mass is attached to. Relative movement between the key mass and the spring mass is along shear surface 105. Spring mass 100 and key mass 102 both may be shielded. Referring for example to FIGS. 32, 37, 46, and 50, the key mass, spring mass, and their shear surfaces are shielded behind the outer shell of the lock. Thus a strong outer shell can be used to protect the locking mechanism against destructive force entry attacks such as drilling, and the "screw driver and wrench" (Marc Weber Tobias, J. D., "Locks, Safes, and Security," Vol. 1 and 2, $2^{nd}$ Edition, 2000, Charles C. Thomas Publisher, LTD., and Marc Weber Tobias, J. D., "High Security Lock Standards and Force Entry: a Primer," htip://download.security.org/forced_entry_2007.pdf) or, the bypass methods such as "drilling and shimming," (Marc Weber Tobias, J. D., "Locks, Safes, and Security," Vol. 1 and 2, $2^{nd}$ Edition, 2000, Charles C. Thomas Publisher, LTD.).

Operation of the MMLS is a function of the motion of spring mass 100 relative to key mass 102 along the shear surface 105. Depending on the shape of the abutment sides 107 and 108, movement can be for example linear sliding movements in any linear direction on the abutment sides 107 and 108, rotational movement about an axis normal to the abutment sides, rotational movement about an axis normal to both spherical sides (in an example spherical configuration), rotational movement about the axis of both cylindrical shear surfaces (in an example cylindrical configuration), axial sliding movement of cylindrical contact surfaces (in another example cylindrical configuration), or the combination of aforementioned movements.

Figure 2:
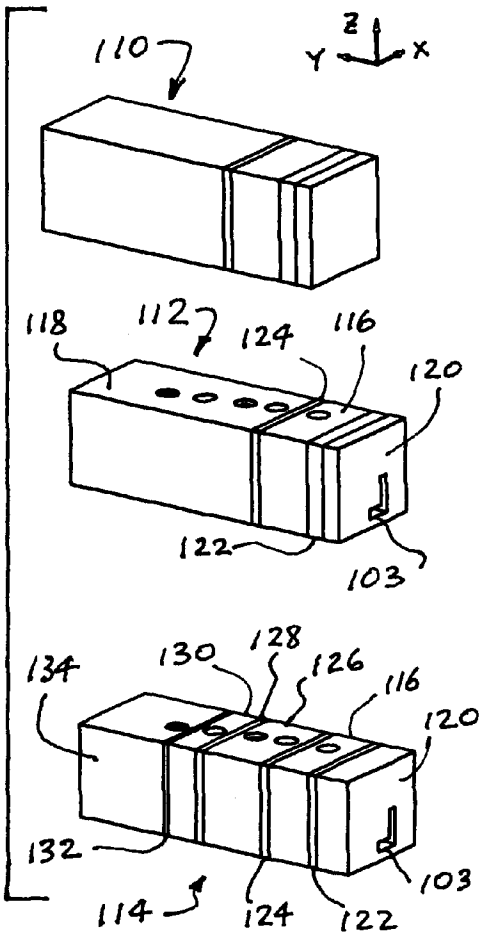
FIG. 2 shows the spring mass and two examples of the key mass of FIG. 1 separately, with various sandwich constructions.

For providing higher resistance to drilling, milling, thermal, or chemical attack, and corrosion, the spring mass 100 and key mass 102 can be made of a monolithic piece with hardened steel or stainless steel, instead of softer metals such as brass as is typically necessary for conventional cylinder lock systems. The key mass 102 can be embedded and rigidly attached to the surrounding stationary components of the lock, because it is not needed to function as a conduit for the transfer of force from the key to open the lock. Some key masses 102 are typically subjected to only comparatively small forces from the spring mass 100 in X-axis direction, as detailed below. Those forces need only operate on the surrounding stationary components of the lock, without having to be transferred in Y-axis direction. For the key mass of this kind of lock, the rigidity of the load path and the structural continuity in the Y-axis direction may not be particularly important. Thus, to protect from various kinds of attack, one or both the spring (100) and key (102) masses may be of a sandwich construction as shown in FIG. 2, in which the spring mass is designated 110 and two possible key masses are designated 112 and 114. These three masses 110, 112, and 114 can each be made of several segments and layers coupled together. Referring to key mass 112 as an illustrative case of this compound mass construction, it is comprised of several segments, two of which are designated 116 and 118. To resist drilling or milling, a layer of high rating alloy hard plates 120, with the keyway 103 cut out, can be attached at the front end of the key mass 112. Behind that, additional two or more plates with the keyway cut out (here, layers 122 and 124) are added. All these pieces can be stacked and attached firmly to one another. Alternatively, these additional layers can be made of copper, concrete, ceramic, et cetera to thwart specific kinds of attack, e.g., force, thermal, or chemical attacks. A second approach is a meltable sandwich construction. For example, in the key mass 114, layers 122, 124, 128 and 132 and/or other layers can be made of low-melting point alloy, sandwiched between the hard plate 120 and segments 116, 126, 130, and 134, or in other places. During a drilling or milling attack on the hard plate 120 toward the end of key mass 112, the heat generated from the drilling or milling, melts the low-melting point alloy layers. Then, the melted alloy will be compressed by the drill or mill, squeezing through gaps to reach other components of the lock. This liquefied alloy, or after solidified, will bond other components of the lock together, making the lock more resistant to the attack. Another sandwich construction approach is the detachable sandwich, wherein the key mass is made with a stack of separable—that is, not affixed or adhered to one another—layers that can share the same keyway. While some layers may be separable in this manner, others may be attached to one another. For example, in FIG. 2, the key mass 112 can itself be comprised of a multiple slices as shown. These slices and others, comprise a stack of separable or lightly attached layers. An advantage of using a detachable sandwich arrangement is in countering a "screw driver and wrench" attack, in which the tip of a screwdriver is inserted into the keyhole 103, and a torque is applied to the lock. As the keyway may be small and narrow, or may be curved, as detailed below, a screwdriver inserted in this manner will not penetrate the length of the keyway and key mass. Thus, the screw driver may reach only the segment or segments near the front of the keyway entrance, but not the segments near the end. When the wrench is turned to rotate the screw driver, it will only destroy the locked spring pins at the front segments, but not those in the detached segments beyond.

Key hole 103 is configured to receive a key inserted into a keyway in the key mass 102 extending generally along the Y-axis direction. As detailed below, the keyway can be straight, or it can be bent in single curvature circular arc on the X-Y plane, or bent in a single curvature circular arc on the Y-Z plane, or bent in a multi-curvature curve on the X-Y plane. In case of multi-curvature curve, the curve should be a smooth and continuous curve, composed of two or more curves, some of which could be straight lines. The blade of the corresponding key can be curved in a conforming manner, or it can be pliant or flexible so as to curve upon insertion.

Figure 3:
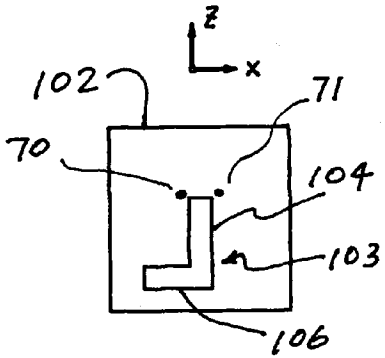
FIG. 3 shows the elevation view on X-Z plane of the end surface of the key mass 102 of FIG. 1.

The keyway can have various cross-sectional shapes, as further detailed below. These can include an L-shaped cross-section, as show in FIGS. 1-3, or an inverted T shape (not shown). The L-shaped cross-section keyway shown in FIG. 3 is the combination of a bit flange channel 104 and a base bar channel 106. Another possible configuration has a rectangular shaped cross-section, shown in FIGS. 18, 46, 47 and 49, and is effectively only the bit flange channel such as 104 above. Another configuration is that of a compound keyway, which has one base bar channel and two or more bit flange channels, such as is shown in FIGS. 28, 30, 50, 51, 54, and 55.

Figure 20:
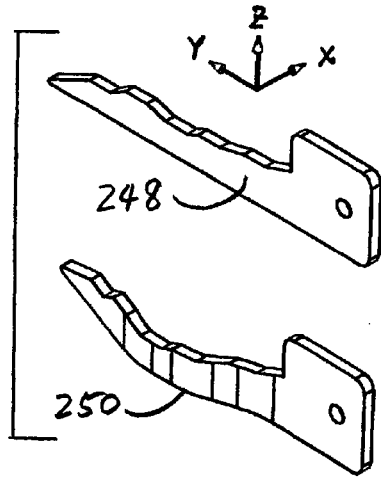
FIG. 20 shows the two perspective views of the correct flexible key before and after inserting into the multi-curvature keyway.
Figure 29:
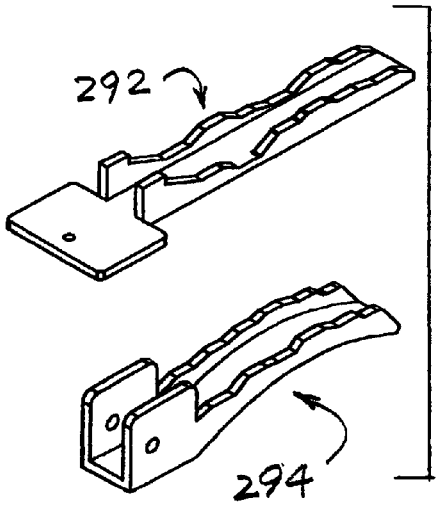
FIG. 29 is the perspective views of two compound keys suitable for the compound keyway of FIG. 28.
Figure 30:
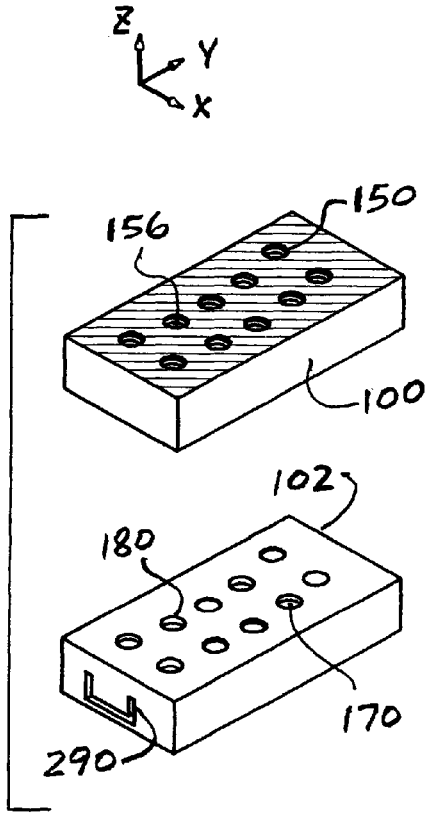
FIG. 30 is the partial exploded perspective view of a set of compound spring mass and compound key mass, with compound keyway.
Figure 31:
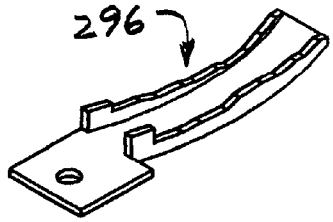
FIG. 31 is the perspective views of a bent compound key suitable for the compound keyway of FIG. 30.
Figure 49:
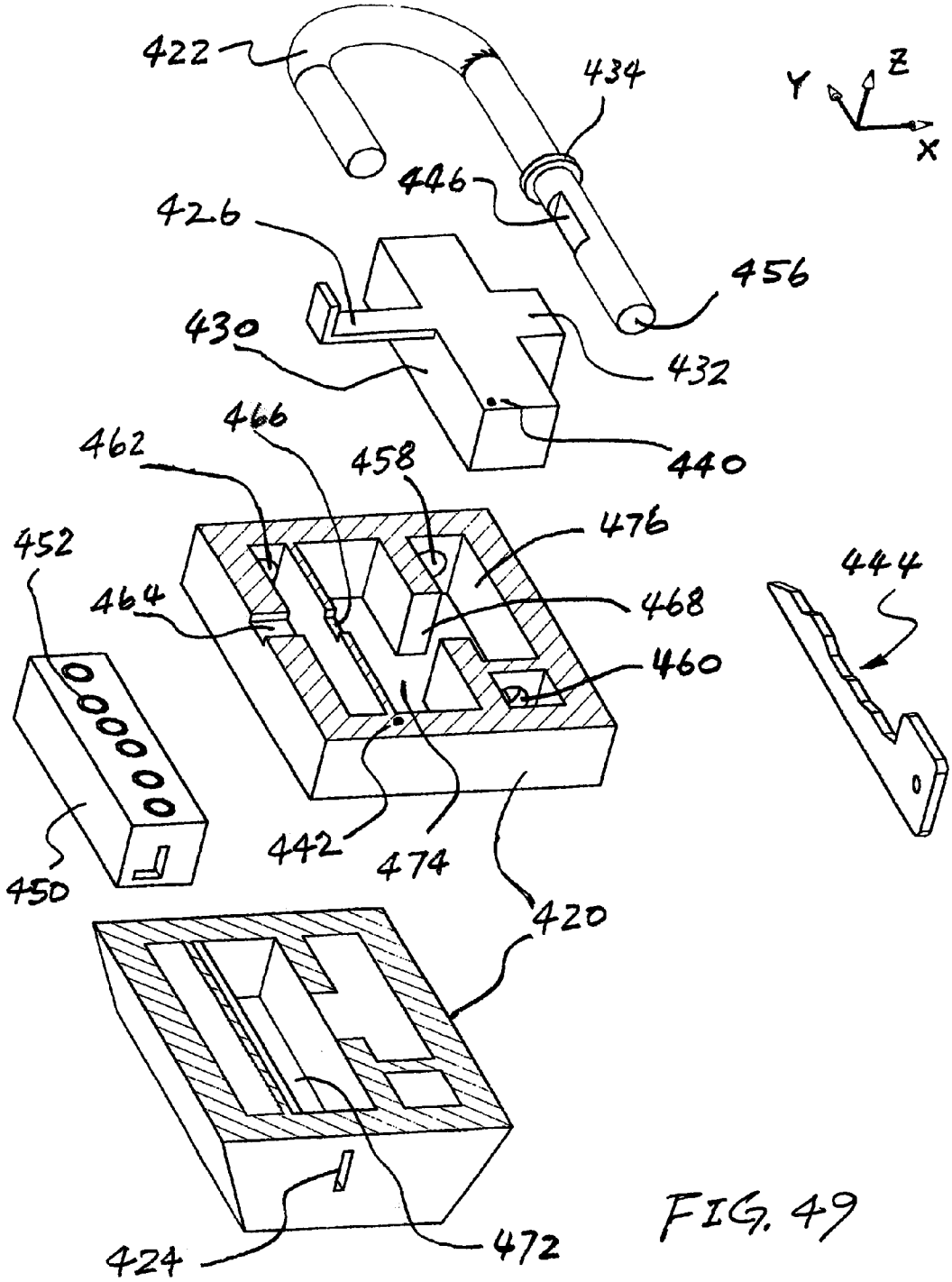
FIG. 49 is an exploded perspective view of the pad lock in FIG. 47.
Figures 53, 54:
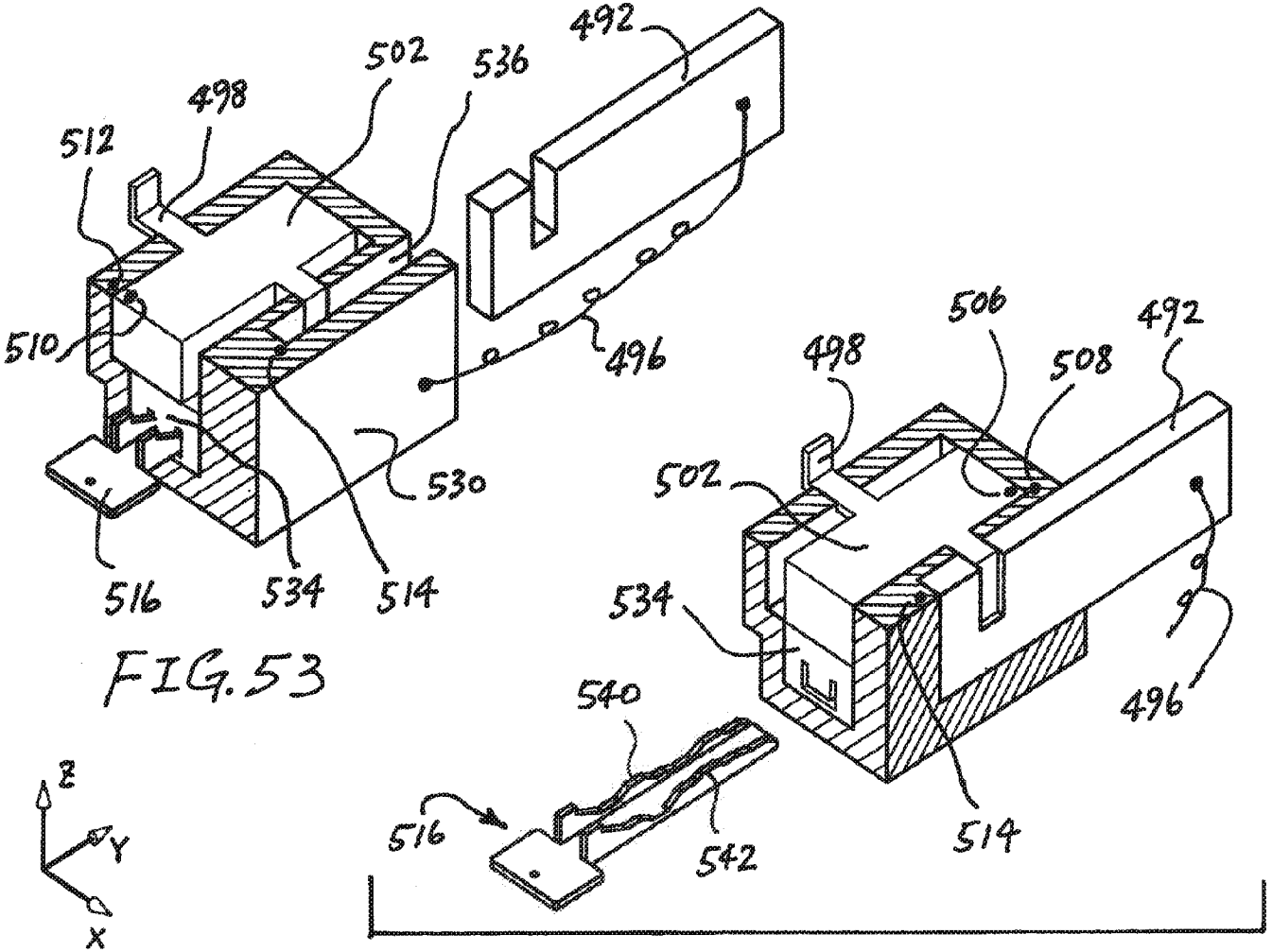
FIG. 53 is the perspective sectional view of the cable lock in FIG. 52.
FIG. 54 is a perspective sectional view of the cable lock in FIG. 53.

The keys corresponding to the above possible keyways include an L cross-section key such as is shown FIGS. 10-14, 17 and 45 (or an equivalent inverted T-shape key for an equivalent inverted T-shape keyway), a rectangular cross-section key as shown in FIGS. 20 and 49, and a compound cross-section key as shown in FIGS. 29, 31 and 54.

Figure 11:
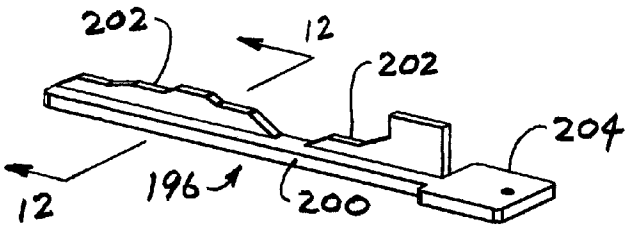
FIG. 11 shows a perspective view of the correct key in FIG. 10.
Figure 12:
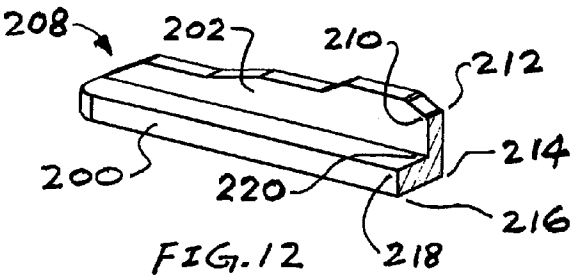
FIG. 12 is the front piece of the key in FIG. 11, cut off along the line 12-12.

FIG. 11 shows an example straight L-shape key 196. It comprises a base bar 200, bit flange 202 (also referred to as a blade), and a bow 204. The bit flange 202 can be either continuous along the length of the key, or discontinuous as shown. The discontinuity of bit flange 202, and one of the key pins near the keyway entrance having its top near or at the contact surface, can help to obstruct picking of the lock. A better view of the cross-sectional shape of key 196 is shown in FIG. 12, which is an enlarged view of the segment of the key from section cut 12-12 of FIG. 11, to the tip of the key. The segment within the points 210, 212, 214, and 220 is the bit flange 202 which provides the identity of the key. While the segment within the points 214, 216, 218, and 220 is the base bar 200 which provides strength and rigidity to the key to support the bit flange 202.

A sample of a bendable rectangular key 248 is shown in FIG. 20, in which the top figure depicts the straight key in the straight configuration, and the bottom figure depicts the key in the curved configuration, achieved when the key is inserted in the corresponding curved keyway, curved in the X-Y plane. Samples of compound key are shown in FIG. 29, as 292 and 294; and in FIG. 31, as 296. They are similar to L-shape key, except that they have more than one row of bit flange. Multi-curvature keyway should have corresponding rectangular keys made of flexible material because, the key will be bent one or more times during inserting into, and pulling out of, the keyway. Therefore, the key should be made of flexible and durable material, with a thin cross section which can be bent easily with very low bending stress. As key 248 is generally a thin plate with a rectangular cross section, the cross section of the multi-curvature keyway will be small and narrow. A multi-curvature, small, and narrow keyway makes any bypass attack almost impossible. The keyway can have wards (not shown), with matching grooves provided on the key.

Figure 4:
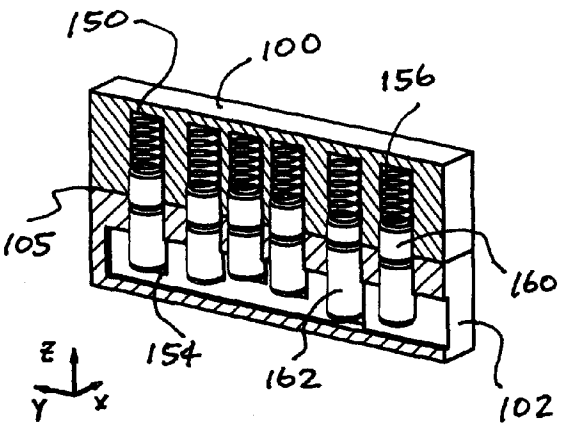
FIG. 4 is the longitudinal sectional perspective view of the spring mass and key mass.
Figure 6:
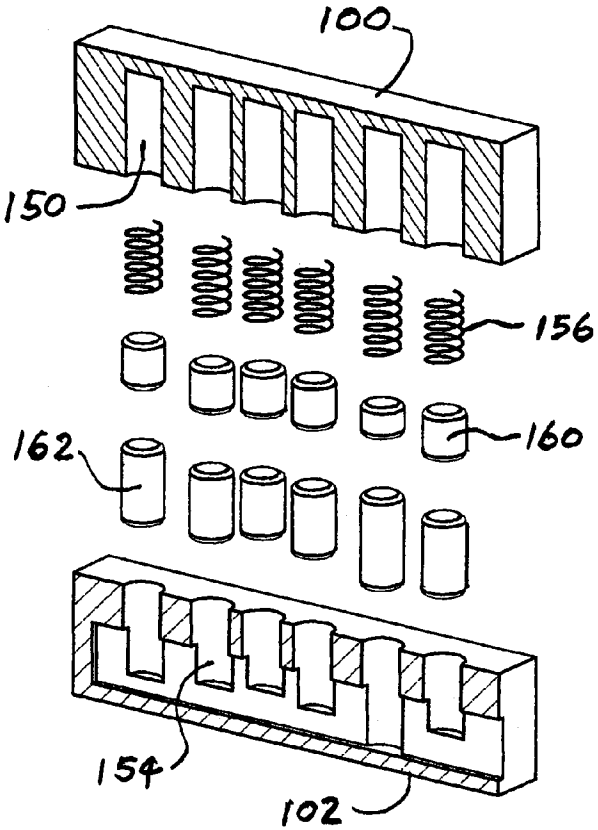
FIG. 6 is an exploded perspective sectional view of the embodiment in FIG. 4, with all the springs, spring pins, and key pins.
Figure 5:
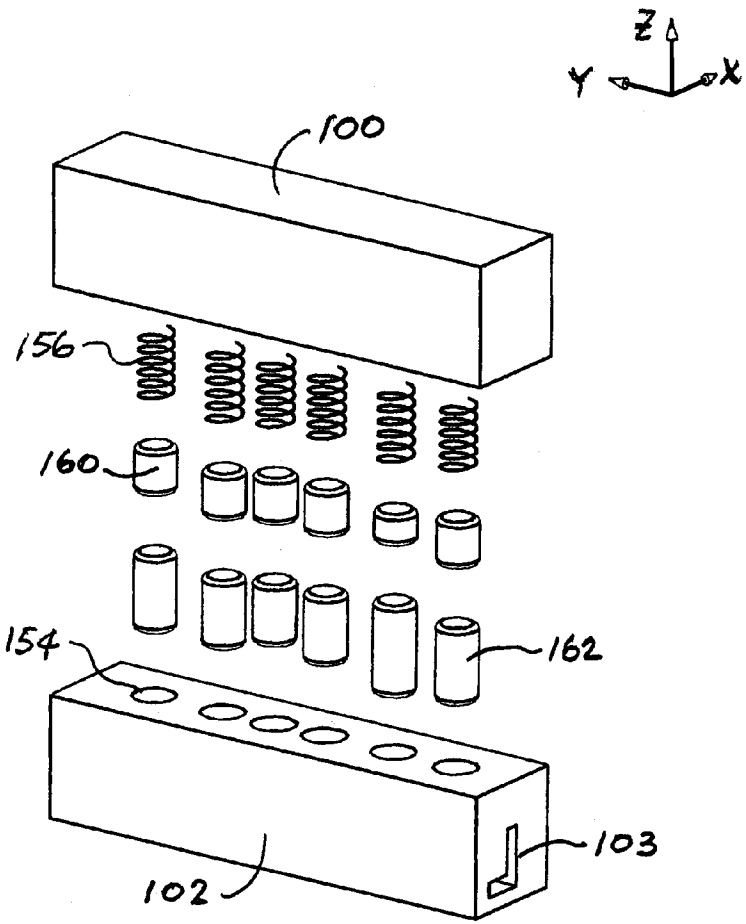
FIG. 5 is an exploded perspective view of the embodiment in FIG. 1, with all the springs, spring pins, and key pins.
Figure 7:
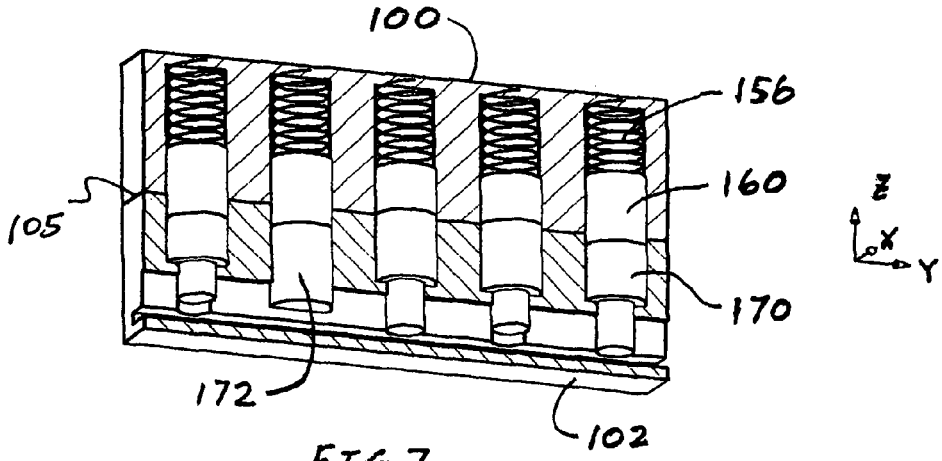
FIG. 7 is the longitudinal sectional perspective view of another set of spring mass and key mass, similar to FIG. 6.

Reference again is made to FIG. 1, showing spring mass 100 and key mass 102 as used to explain the double-acting detainer locking mechanism in the design of MMLS. The key mass 102 has an L-shape keyway 103. FIG. 3 is the elevation view of the near end of key mass 102. FIGS. 4 and 7 are examples of two possible longitudinal sectional perspective views of the spring mass 100 and key mass 102 of FIG. 1. The sectional views are cut by a Y-Z plane located at the middle between points 70 and 71 of the key-bit channel 104, which is shown in FIG. 3. FIG. 4 is the view looking toward the positive X-axis direction, while FIG. 7 looking toward the negative X-axis direction. FIGS. 5 and 6 are the exploded views of FIGS. 1 and 4, respectively. As shown in FIGS. 4 and 6, there are six spring bores 150 in the spring mass 100, and six cylindrical key pin bores 154 of various lengths in the key mass 102. In the spring mass 100, each spring bore has a spring 156 and spring pin 160 which reciprocates in the spring bore.

The key mass 102 can include two features pertaining to the key pin and key pin bore to guard against the bypassing through the bump key technique (also known as "999 rapping key") and "Falle Pin Lock Decoder" technique. The first feature is the cylindrical key pin 162 inside the cylindrical key pin bore 154, as shown in FIGS. 4 and 6. The key pin bores 154 penetrate from the contact surface down toward the keyway, but stop at various depth, such that, the bottom of their key pins stop at various heights.

Figure 8:
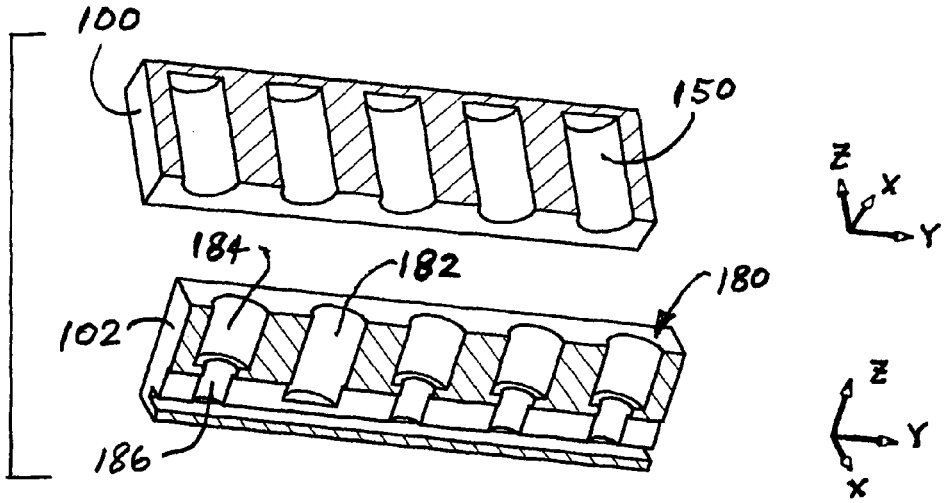
FIG. 8 shows the half-pieces 100 and 102 of FIG. 7, with each piece rotated slightly about Y-axis.
Figure 9:
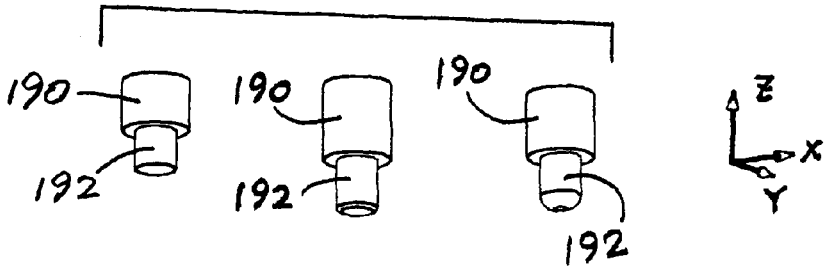
FIG. 9 shows the perspective view of three types of stepped key pins.

The second feature is a stepped key pin 170 inside a stepped key pin bore 180, as shown in FIGS. 7 and 8. To render better views of the spring bores, and particular the stepped key pin bores, from FIG. 7, all springs 156, spring pins 160, stepped key pins 170, and the cylindrical key pin 172 are removed from spring mass 100 and key mass 102. Then, separate the two masses, and rotate each one slightly in opposite directions about the Y-axis; the result is shown in FIG. 8. Samples of three stepped key pins of different configurations are shown in FIG. 9, each having a larger key pin head 190, and a smaller key pin tail 192. As shown in FIG. 8, the stepped key pin bore 180 has two bore segments of different diameter. The larger stepped bore segment 184, housing the key pin head 190, penetrates down from the shear surface toward the keyway, but may stop before reaching the keyway. The smaller stepped bore segment 186, housing the key pin tail 192, penetrates down starting from the bottom of the larger stepped bore segment 184, and ending at the bottom of the keyway. In the key mass 102, each key pin bore has one key pin that reciprocates therein, with either cylindrical or stepped configuration. As shown in FIG. 7, a key mass 102 can have both stepped key pin 170 and cylindrical key pin 172. They serve the same function if having the same length; but, the height of the bottom of stepped key pin can be altered as desired. The stepped configuration protects against decoding a cylinder lock with the "Falle Pin Lock Decoder" method, in which a fine shim wire of the decoder is extended upward from the keyway along the side of the lower pin until it reaches the bottom of the driver pin. Then, the length of the lower pin is measured to create a suitable key. The stepped key pin configuration prevents this kind of decoding. As can be seen from FIG. 9, when the fine shim wire moves up from the keyway along the side of the key pin tail 192, it will be stopped by the bottom of the key pin head 190. While all spring bores, spring pins, springs, cylindrical or stepped key pins and their corresponding key pin bores are shown to have a circular cross section, and, their axes are parallel to each other, this is not by way of limitation, and other configurations are possible.

In conventional cylinder locks, the bottom of all tumbler pins may rest at the same height. Thus, one "999 rapping key" with all cuts to the deepest point (so that automatically every ramp presses against the bottom of a corresponding tumbler) can be used to bump open all locks of the same keyway. In the arrangement as described herein, by contrast, and as in the examples shown in FIGS. 4 and 7 in particular, the bottoms of some or all key pins rest at different heights. In addition, variable separation distances between key pins places the resting points of the bottom of key pins at variable locations unknown to a picker. So, rapping key with various height ramps at various locations must be made specifically for each lock. That makes picking by the key bumping method much more difficult. Also, the springs, spring pins and spring mass bores have various lengths, decoding of the length of key pins with the tool as shown in U.S. Pat. No. 4,535,546 is prevented.

Figure 13:
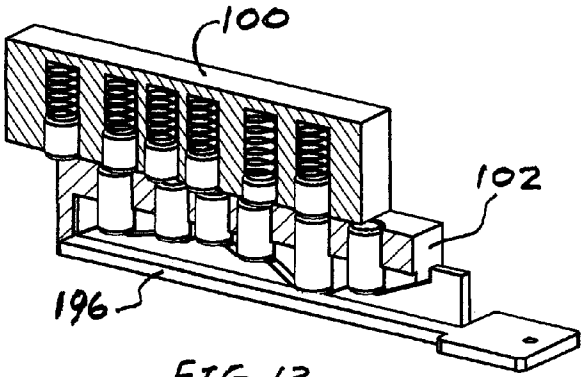
FIG. 13 and FIG. 14 show the spring mass of FIG. 10 moving in X-axis direction, and in Y-axis direction, respectively.
Figure 14:
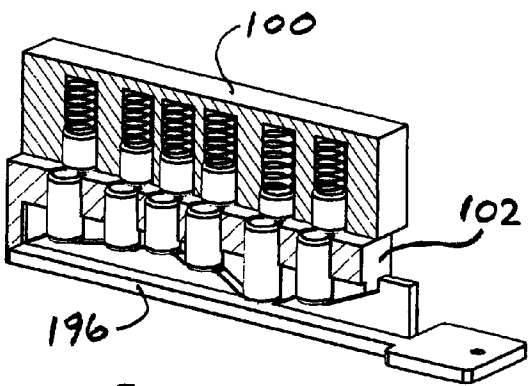
Figure 10:
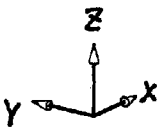
FIG. 10 is the longitudinal sectional perspective view of the spring mass and key mass of FIG. 4, with the correct key inserted in the keyway.
Figure 10:
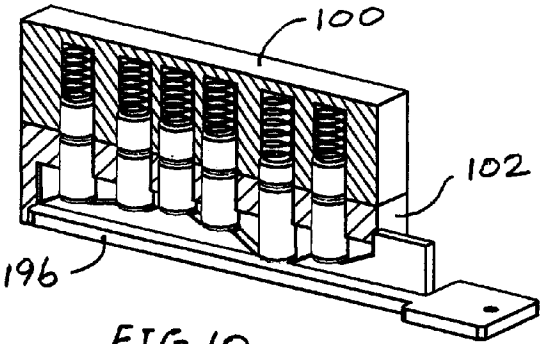

When the lock is in locked mode, as shown in FIGS. 4 and 7, each spring bore lines up with the corresponding key pin bore. Each pair of these bores has the lower opening of spring bore matching with the upper opening of key pin bore, across the shear surface 105 of the two masses 100 and 102. Key pins and spring pins can move freely within such pair of bores across the shear surface 105; when they are biased by the spring in the spring mass 100, or the key bit in the key mass 102. Within a pair of matching bores, the longitudinal axes of spring bore, spring, spring pin, key pin bore, and key pin are aligned. Also, within the two masses, coincided longitudinal axes of all bore pairs are parallel to each other. Further, when a correct key is inserted into the keyway, all these longitudinal axes lie on the middle surface of the bit flanges 202 of the key such that all key pins will be pushed into the spring mass 100 up by the bit flanges. In turn, the key pins will push up the spring pins, and compress the associated springs. When the tops of all the key pins are raised to the shear surface level, there is no more restrain to the sliding movement between the spring mass 100 and the key mass 102, and the lock is thus switched from locked mode to unlocked mode. An example of this operation is shown in FIG. 10. FIG. 10 shows the sectional perspective view of the two masses 100 and 102 in FIG. 4, with the correct key 196 inserted in the keyway. The perspective views of the key 196 and its tip segment 208 are shown in FIGS. 11 and 12, respectively. Thus, in this unlocked position, the spring mass 100 is free to slide along the shear surface 105. FIG. 13 shows that the spring mass 100 is slid toward positive Y-axis direction, and, FIG. 14 shows that the spring mass 100 is slid toward positive X-axis direction. Obviously sliding in any direction along the shear surface 105 is contemplated. Afterward, if the spring mass 100 is moved back to the locking position and the key is removed, all springs push the spring pins and key pins down to the original position. If a cylindrical key pin is used, the downward movement will be stopped when the bottom of the cylindrical key pin reaches the bottom of the cylindrical key pin bore. On the other hand, if stepped key pin is used, the downward movement will be stopped when the bottom of the key pin head reaches the bottom of the larger segment of the stepped key pin bore. Meanwhile, the spring pin is pushed down beyond the shear surface, and enters the key pin bore. Thus, the spring pin restrains the spring mass from any sliding movement; the lock is in locked mode.

Figure 15:
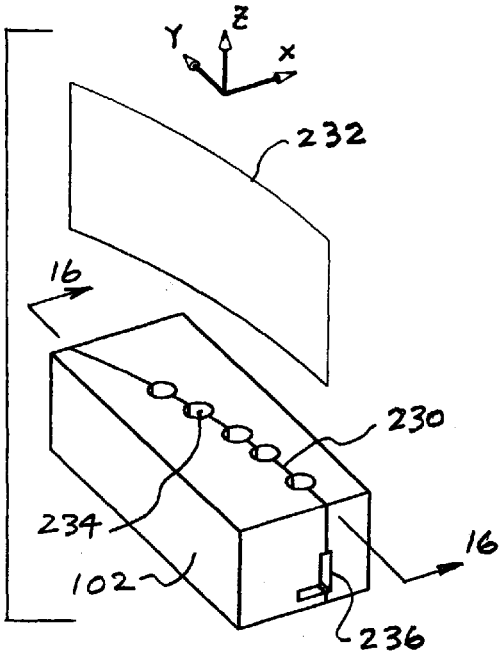
FIG. 15 shows a perspective view, of a single curvature curve-surface which is normal to the X-Y plane, and a key mass cut by that curve-surface.
Figure 16:
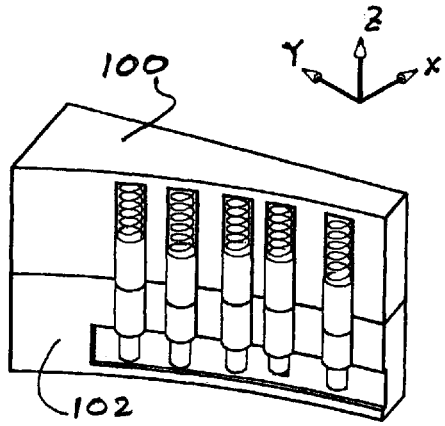
FIG. 16 is a curved sectional perspective view of a spring mass and key mass set, cut by the single curvature curve-surface of FIG. 15.
Figure 17:
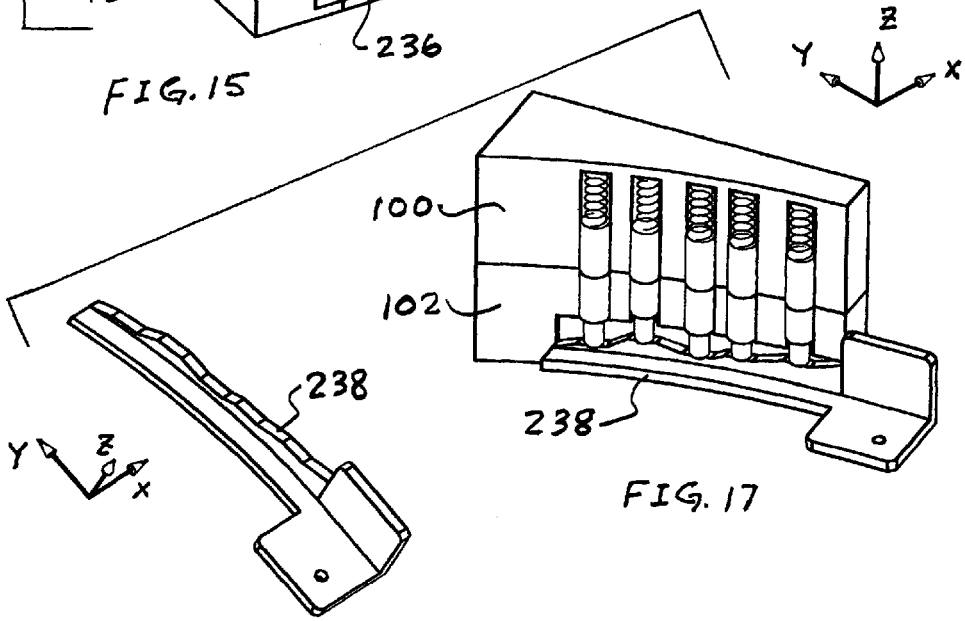
FIG. 17 shows the perspective views of the spring mass and key mass set of FIG. 16 with a correct curved key of single curvature inserted into its keyway, and the correct curve key.

Aforementioned internal construction and operations of the masses 100 and 102 for straight keyway and key are applicable also to the following three cases of different configuration of keyway and key. The first case has the keyway and key bent in single curvature circular arc on the X-Y plane. A perspective view of the key mass 102 with a circular arc 230, keyway 236, and a circular cylindrical surface 232 are shown in FIG. 15. The circular arc 230 is equivalent to the single curvature circular arc of the bit flange channel of the keyway 236, and the bit flange of the key. It lies on the shear surface of the key mass 102, passing through the central axis of all key pin bores 234. The circular cylindrical surface 232 has its generatrix normal to the X-Y plane. The central axis of all key pin bores 234 coincide with the generatrix of the circular cylindrical surface 232; and, the circular arc 230 coincides with the directrix of the cylindrical surface 232. The key mass 102 alone cut with the cylindrical surface 232 creates a curved sectional view 16-16 which is shown as the lower piece in FIG. 16. FIG. 16 is a curved sectional view of spring mass 100 and key mass 102 cut by the circular cylindrical surface 232 the same way as in FIG. 15. The pair of masses have their keyway, springs, spring pins, and key pins located on directrixes of the circular cylindrical surface 232. FIG. 17 shows the items in the curved sectional view of FIG. 16, after the correct circular bent key 238 inserted into the key mass 102. Then, all the key pins are pushed up so that their tops align with the shear surface, freeing the spring mass 100 to slide from the key mass 102.

Figure 18:
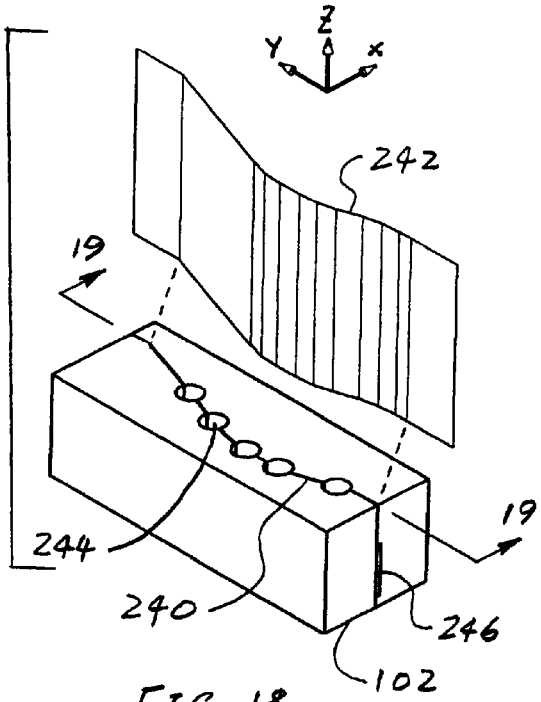
FIG. 18 shows a perspective view, of a multi-curvature curve-surface which is normal to the X-Y plane, and a key mass cut by that curve-surface.
Figure 19:
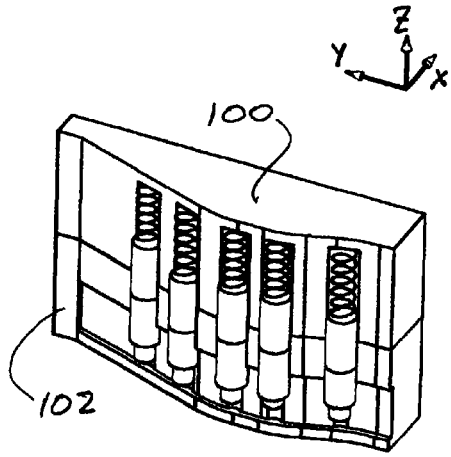
FIG. 19 is a curved sectional perspective view of a spring mass and key mass set, cut by the multi-curvature curve-surface of FIG. 18.
Figure 21:
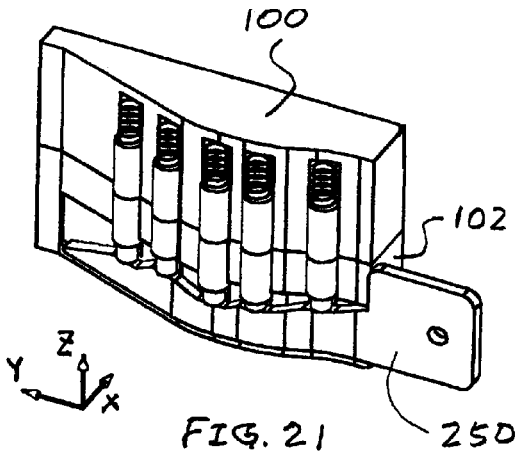
FIG. 21 shows the perspective view of the spring mass and key mass set of FIG. 19, with a correct flexible key inserted into its multi-curvature keyway.

The second case has the keyway and key bent in a multi-curvature curve on the X-Y plane. A perspective view of the key mass 102 with a multi-curvature curve 240, rectangular keyway 246, and a multi-curvature surface 242 are shown in FIG. 18. The curve 240 is equivalent to the multi-curvature curve of the keyway 246. It lies on the shear surface of the key mass 102, passing through the central axis of all key pin bores 244. The multi-curve surface 242 has its generatrix normal to the X-Y plane. The central axis of all key pin bores 244 coincide with the generatrix of the multi-curvature surface 242; and, the multi-curvature curve 240 coincides with the directrix of the curved surface 242. The key mass 102 alone, cut with the curved surface 242, creates a curved sectional view 19-19 which is shown as the lower piece in FIG. 19. FIG. 19 is a curved sectional view of spring mass 100 and key mass 102 cut by the curved surface 242 the same way as in FIG. 18. The pair of masses has their keyway, springs, spring pins, and key pins located on directrixes of the curved surface 242. FIG. 20 shows two configurations of the flexible multi-curvature bent key; the top drawing depicts the key in a free state before insertion into the keyway 246; and, the bottom drawing depicts it after insertion into the keyway 246 of key mass 102 of FIG. 19. FIG. 21 shows the items in the curved sectional view of FIG. 19, after the correct key 248 inserted into the key mass 102 and bent to conform to the shape of the keyway. Then, all the key pins are pushed up with their tops reach the shear surface so that the spring mass 100 is free to slide away from the key mass 102.

Figure 22:
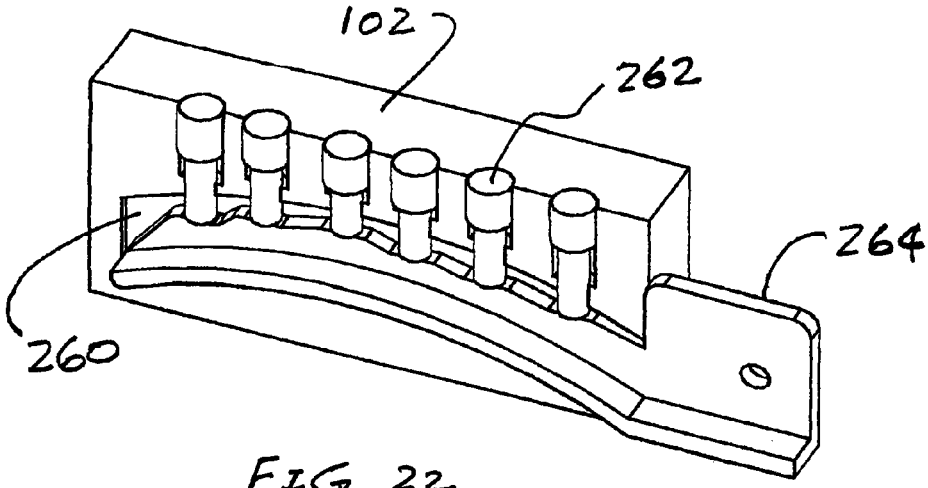
FIG. 22 shows a longitudinal sectional perspective view of the key mass, taken near its longitudinal center line. A correct curved key is inserted into the single curvature curved keyway.
Figure 23:
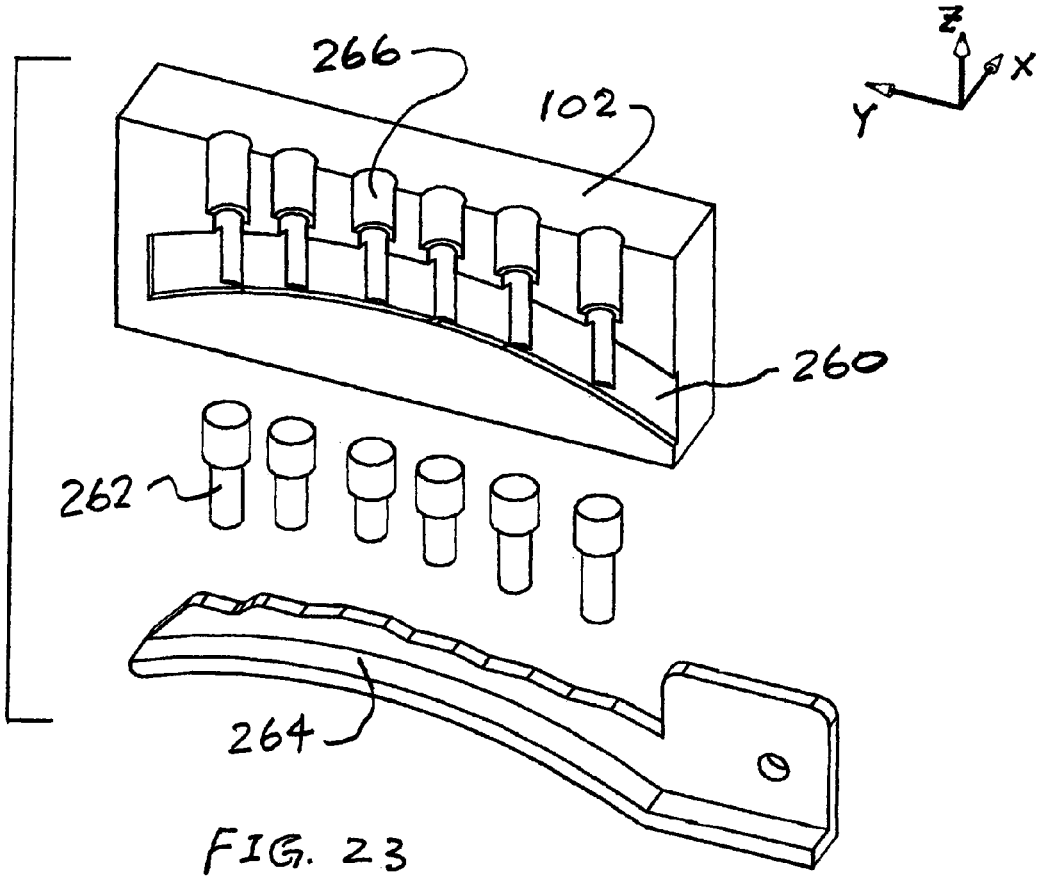
FIG. 23 is the exploded perspective view of FIG. 22.

The third case has the keyway and key bent in single curvature circular arc in the Y-Z plane. A perspective sectional view of the key mass 102 with a circular arc keyway 260, straightly lined stepped key pins 262, and a circular bent key 264 are shown in FIG. 22. In FIG. 22, the section view is cut by a Y-Z plane surface passing through all the central axes of the stepped key pins. The key 264 pushes up all the stepped key pins, aligning top surfaces with the shear surface. Then, the corresponding spring mass 100 is unlocked and free to slide. FIG. 23 is the exploded view of FIG. 22 to show the detailed view of the bent keyway 260, the stepped key pins 262, the bent key 264, and the stepped key pin bores 266.

Figure 24:
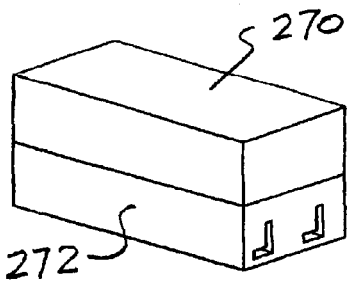
FIG. 24 is a perspective view of a set of compound spring mass and compound key mass with two separate keyways.
Figure 25:
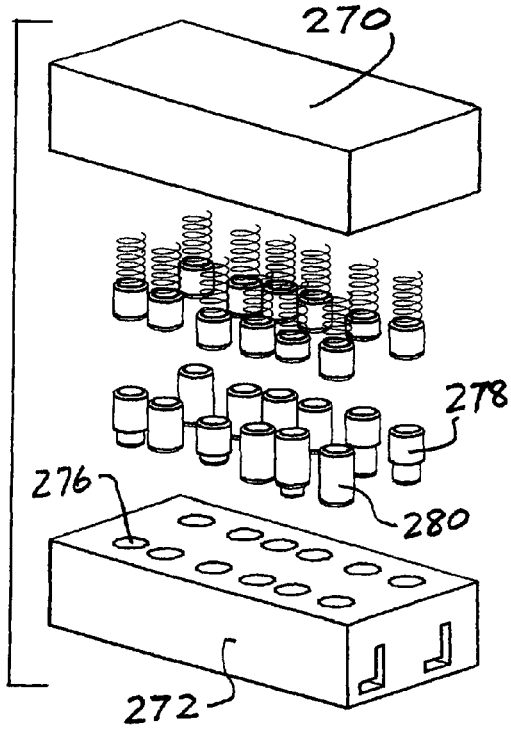
FIG. 25 is the exploded perspective view of the compound spring mass and key mass in FIG. 24.
Figure 26:
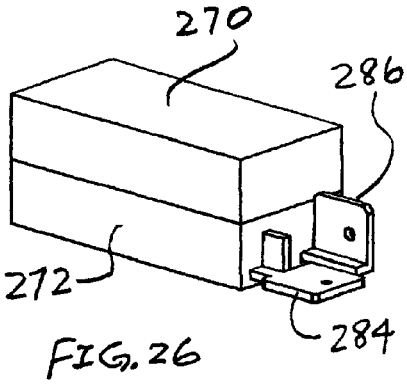
FIG. 26 is the perspective view of the compound spring mass and key mass of FIG. 24, with two separate keys inserted into the compound key mass.
Figure 27:
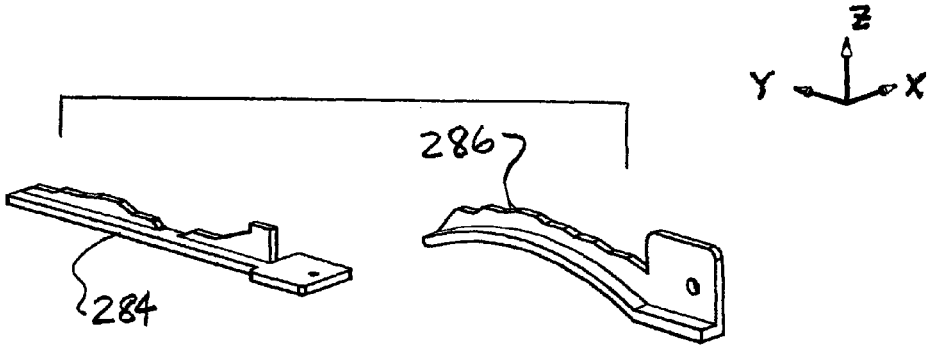
FIG. 27 is the perspective view of the two keys used in FIG. 26.
Figure 28:
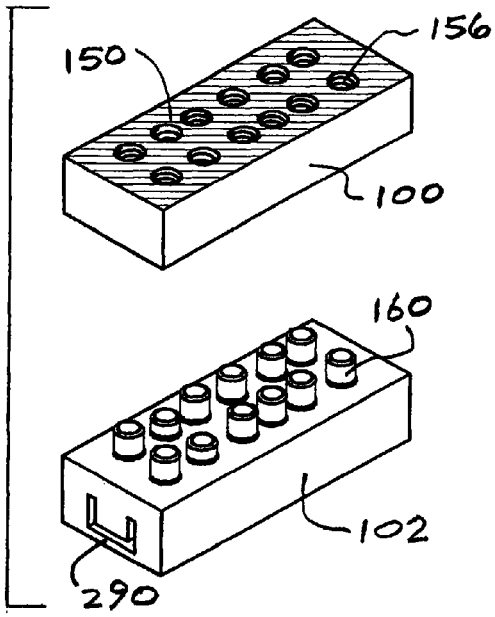
FIG. 28 is the partial exploded perspective view of a set of compound spring mass and compound key mass, with compound keyway. Pins and pin bores are straightly lined up in Y-direction.

Another innovative design of MMLS is combining two or more pairs of spring masses and key masses into one pair of compound spring mass and compound key mass. These pairs of masses can have the same or different internal construction, and configuration of keyway and key. As example, FIG. 24 shows two pairs of spring and key masses combined into a compound spring mass 270 on top, and a compound key mass 272 with two keyways, at the bottom. FIG. 25 is the exploded view of the pair of compound masses of FIG. 24, showing random spacing of key pin bores 276 in the compound key mass 272, and the mix of stepped key pins 278 and cylindrical key pins 280. FIG. 26 shows two keys 284 and 286 which are inserted into the separate keyways in the compound key mass 272. The two keys, straight key 284, and curved key 286 which is curved on Y-Z plane, are shown in FIG. 27. The keyways and keys can have any other configurations. The combination of two or more mass pairs to form a compound mass pair provides several advantages, including: (1) Increasing the number of key pins and spring pins in a lock to as many as needed; (2) A lock having several keys with different curved configurations, particularly with flexible multi-curvature keys, and the keyways separated apart, with numerous key pins inside, makes the bypass by bumping or picking almost impossible; and (3) The compound lock can be opened only when all its correct keys are all inserted, which can be useful for situations requiring multiple authorized personnel for unlocking.

Another variation of MMLS is a compound keyway and key in configurations of straight, single curvature bent in the Y-Z plane, or single curvature bent in the X-Y plane. Since the key mass 102 can be as wide as needed in the X-axis direction, it provides space for a compound keyway with two or more bit flange channels connected to a common base bar channel. The corresponding compound key can thus have two or more bit flanges connected to a common base bar. Thus, the lock can have a large number of key pins and spring pins. The first example is shown in the perspective exploded view of FIG. 28. The spring mass 100 is shown with its top portion removed to show two lines of spring bores 150 and springs 156. In addition, the corresponding key mass 102 with two rows of spring pins 160 and the entrance of compound keyway 290 is shown. As all the spring bores, springs, and spring pins are disposed in straight lines in the Y-axis direction, either the straight compound key 292, or the single curvature bent in the Y-Z plane compound key 294 shown in FIG. 29 is suitable for this lock. The second example is shown in the perspective exploded view of FIG. 30, in which the spring mass 100 is shown with its top portion removed to show two lines of spring bores 150 and springs 156. In addition, the key mass 102 with two lines of key pin bores 180, key pins 170, and the entrance of compound keyway 290 are shown. All the spring bores, springs, key pin bores, and key pins are forming two circular arcs from a family of circles which have the same center but having radius of different lengths in the X-Y plane. Thus, the single curvature, bent on X-Y plane, compound key 296 shown in FIG. 31 is suitable for this lock.

Another variation of MMLS is the safe activator configuration, which is defensible against a large force forced entry attack. The safe activator configuration is one or more mechanical elements, connected to or contacting a mover, such as the spring mass and/or latch implementing the actual locking interference. The mover is intended to be moved by external applied force, and restrained by restrainers. A limitation on the external applied force (called ultimate load hereafter) allowed to be applied is set for the safe activator. The ultimate load equals the product of the maximum reasonable force required to operate the mover when it is not constrained by the restrainers, multiplied by a factor of safety. Such ultimate load should be considerably less than the ultimate allowable force to break the mover, or the restrainers of the lock. Consequently, if the lock in locked mode is under force entry attack with large force, the safe activator will fail first, and the attack force will not be transmitted to the constrained mover and its restrainers. So, the forced entry attack can not unlock the lock.

In MMLS, the key remains dormant after inserting into the lock, and need not provide power to move other components to open the lock. If necessary, the safe activator configuration can be used to move components such as spring mass, stopper, et cetera to open the lock. The safe activator will be explained below in the three types of lock as shown in FIGS. 37 through 55. In general, it is designed to fail with the application of force greater, by a prescribed margin, than the force required to move the spring mass during normal operation.

The designs and components in MMLS have a high degree of interchangeability. For example, the spring and key masses in the following examples are shown as monolithic components. However, they can be replaced with sandwich construction components. The outer shell and key mass of the locks are shown having keyway for single key which has one or two bit flanges, but they can be changed readily to having two or more keyways, and keys each with two or more bit flanges. Furthermore, keys can be straight, single curve bent in the X-Y or Y-Z planes, or multi-curvature on X-Y plane.

Figures 32, 33:
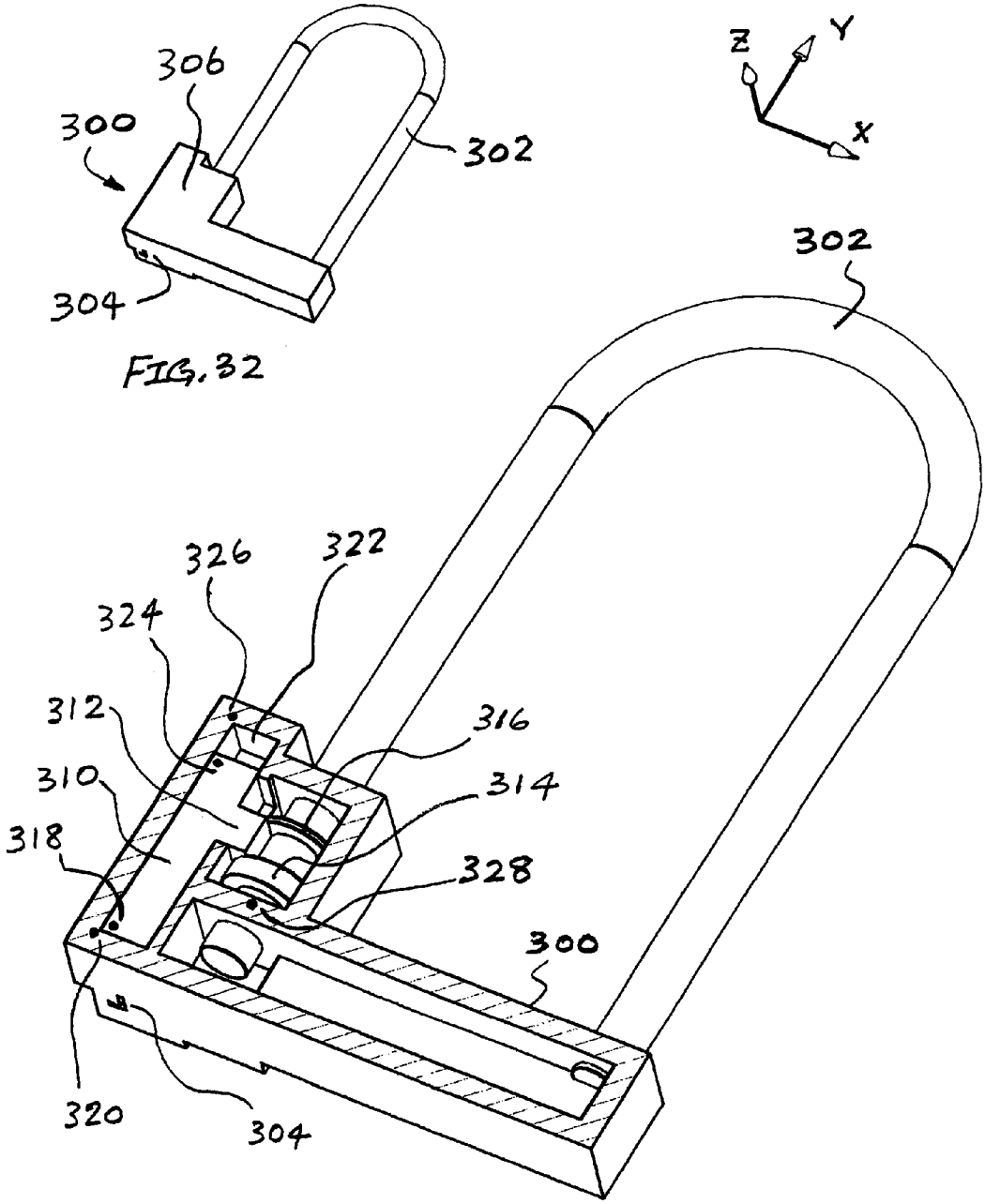
FIG. 32 is the perspective view of a bicycle lock.
FIG. 33 is the perspective view of a bicycle lock, with its top cover removed.
Figure 34:
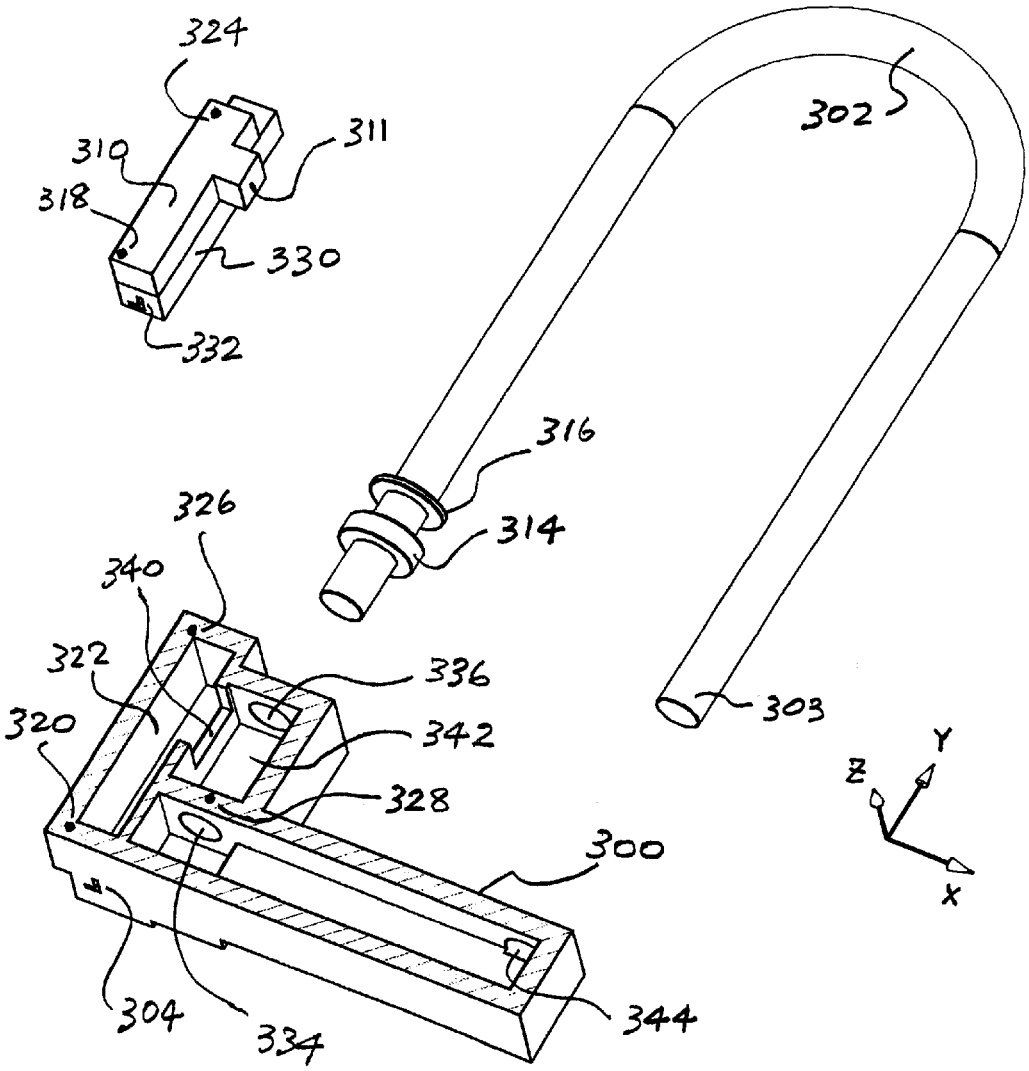
FIG. 34 is an exploded perspective view of the bicycle lock in FIG. 33.

To explain the design and operation of some variations of MMLS locks, four locks are shown in FIGS. 32 through 55. The first lock is a bicycle lock. Its design and operation are shown in FIGS. 32 through 36. A perspective view of the lock in locked mode is shown in FIG. 32, having outer shell 300, shackle 302, keyway entrance 304, and top cover 306. Perspective view of the lock in locked mode, with its top cover 306 removed, is shown in FIG. 33; and its exploded view in FIG. 34. As shown in FIGS. 33 and 34, the lock has spring mass 310 which has an stopper 312, and a matching key mass 330. In FIG. 34, the spring mass 310 and key mass 330 are disposed in the cavity 322 of the outer shell 300. The key mass 330 is firmly attached at the bottom of cavity 322. The key mass 330 has the keyway 332 which aligns with the keyway 304 through the wall of outer shell 300. Spring mass 310 rests against key mass 330. The spring mass 310 is movable only in Y-axis direction within the confines of the cavity 322, with the stopper 312 sliding at the cutout 340 of the partition between the cavities 322 and 342.

In locked mode, as shown in FIG. 33, the corner 318 of spring mass 310 is touching and fitting into the corner 320 of cavity 322. The shackle 302 has two rings 314 and 316 attached rigidly apart at a distance slightly wider than the width of the stopper 312 such that the rings 314 and 316 will not clamp on stopper 312 while the shackle 302 is rotating as explained below. As shown in FIG. 34, one end of the shackle 302 is inserted in the outer shell 300 through holes 334 and 336 such that the shackle can rotate freely during unlocked mode. The other end of it will be inserted into outer shell 300 through the hole 344 when the lock is in locked mode. As this design has no spring-biased locking dog catching the recess at the shackle, it avoids the kind of bypass of inserting a shim between the padlock shackle and the lock body to unlock the lock.

Figure 36:
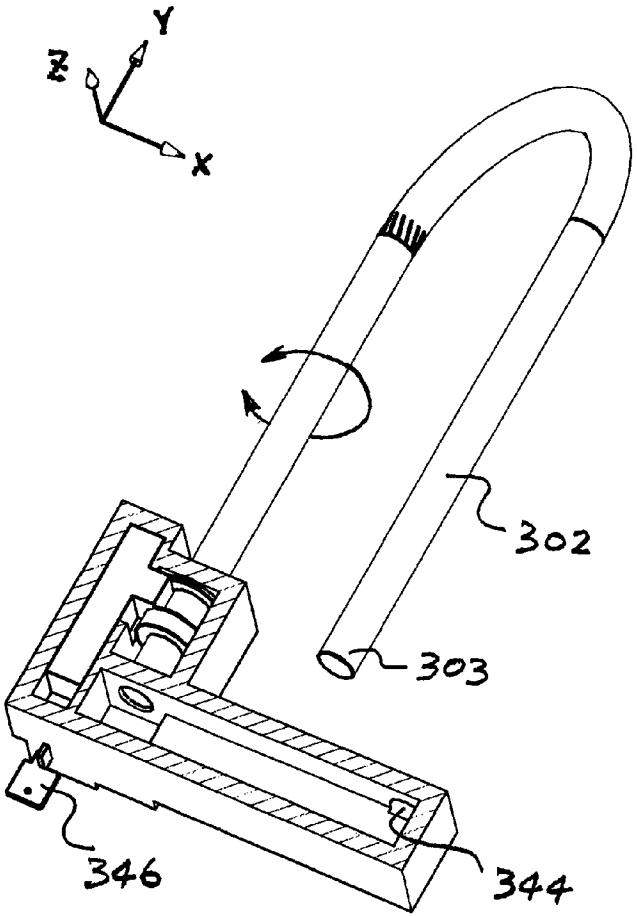
FIG. 36 is a perspective view of the bicycle lock in FIG. 35, with its shackle unlocked and turned.
Figure 35:
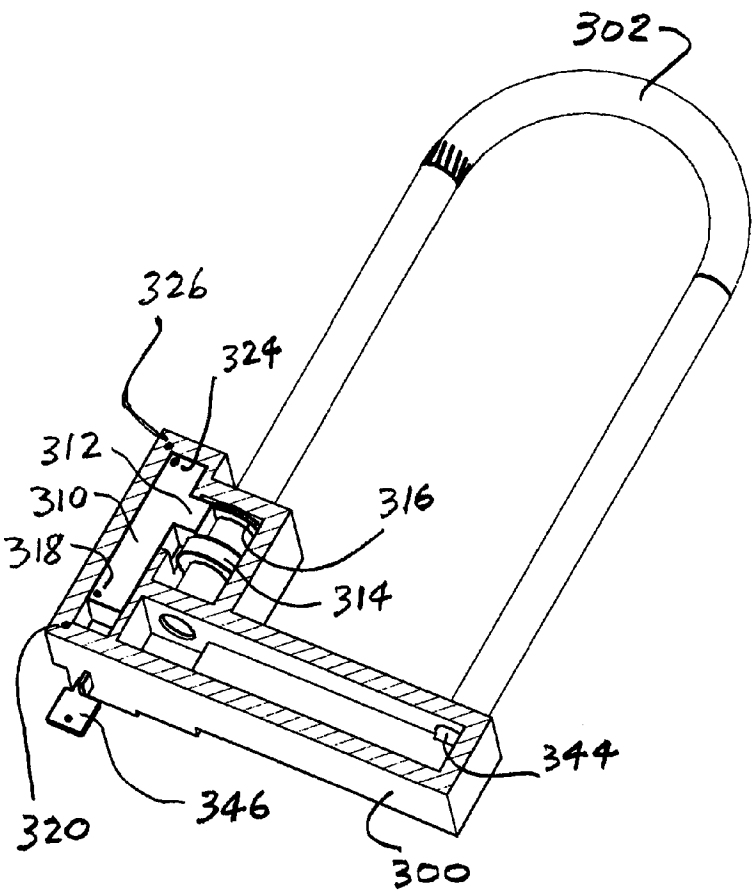
FIG. 35 is a perspective view of the bicycle lock in FIG. 33, with a correct key inserted.

To unlock the above lock, in FIGS. 35 and 36, a correct key 346 is inserted into keyway 304. The key bits push the spring pins out of the key mass 330, leaving no pin saddling between the spring mass 310 and key mass 330. This allows the relative motion in the Y-direction of the key mass and spring mass. This relative motion allows motion of the shackle 302 in the Y-direction. This motion will stop when the corner 324 of the spring mass 310 stops at the corner 326 of cavity 322. Simultaneously, the ring 316 will reach the outer shell wall, and the free end of the shackle 303 is pulled out of the hole 344. FIG. 36 shows the shackle 302 is rotated to complete the unlocking operation.

To re-lock the lock and retrieve the key 346 out of the lock, in FIGS. 34 and 35, the free end 303 is realigned with hole 344 and the shackle 302 is pushed in negative Y-axis direction, replacing the free end of shackle into the hole 344. In turn, ring 316 pushes the stopper 312 and the spring mass 310 to move in the same Y-direction. After corner 318 of the spring mass 310 reaches the corner 320 of cavity 322, all the spring pins in spring mass 310 are aligned and matched with the corresponding key pins in key mass 330; with all their touching ends stop at the shear surface. Now, the free end of the shackle 302 is inserted back to the hole 344. Then, the key 346 can be pulled out of the lock. Without the key bits of key 346 supporting, the springs in the spring mass 310 push all spring pins partially back into the key mass 330. In turn, they push down all the corresponding key pins back to the original positions in the locked mode. Now, the key 346 is free to be retrieved. For unlocking and locking this lock, this design needs no safe activator.

Figure 37:
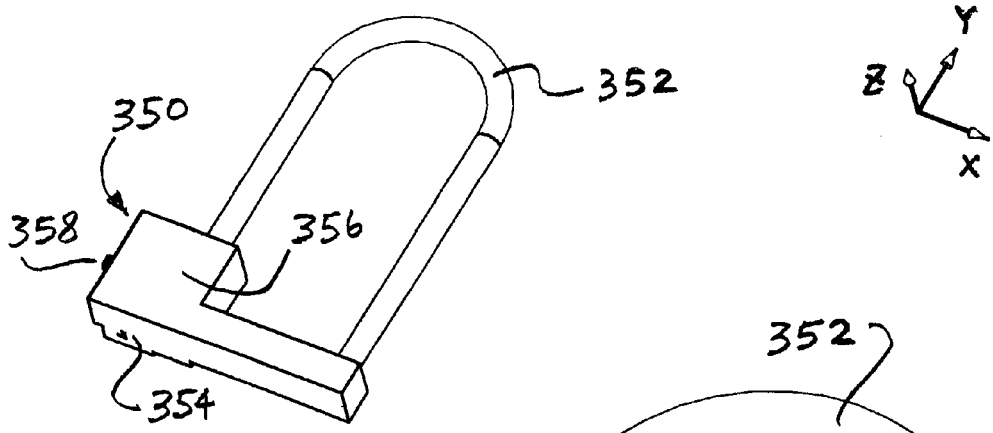
FIG. 37 is the perspective view of a bicycle lock with safe activator.
Figure 38:
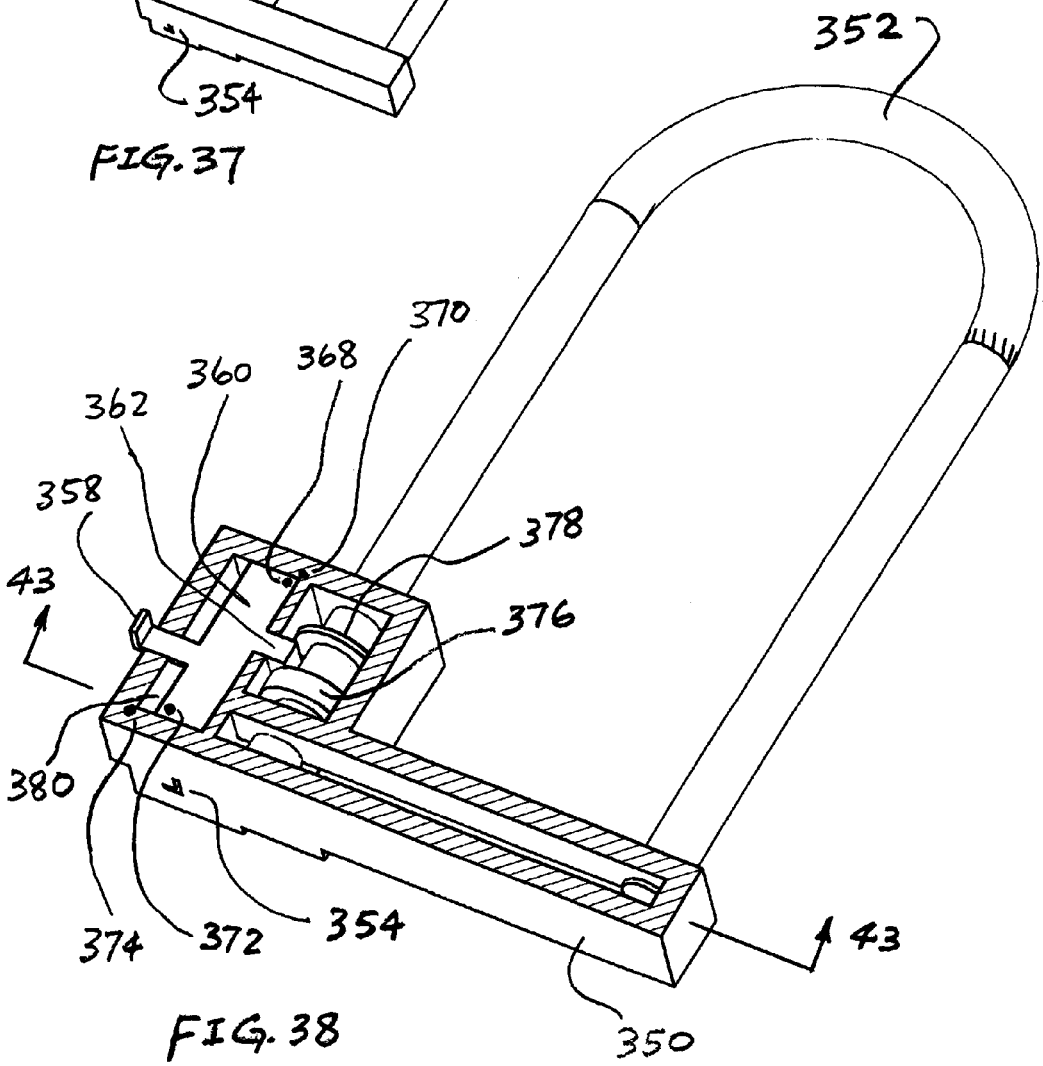
FIG. 38 is a perspective view of the bicycle lock in FIG. 37, with its top cover removed.
Figure 39:
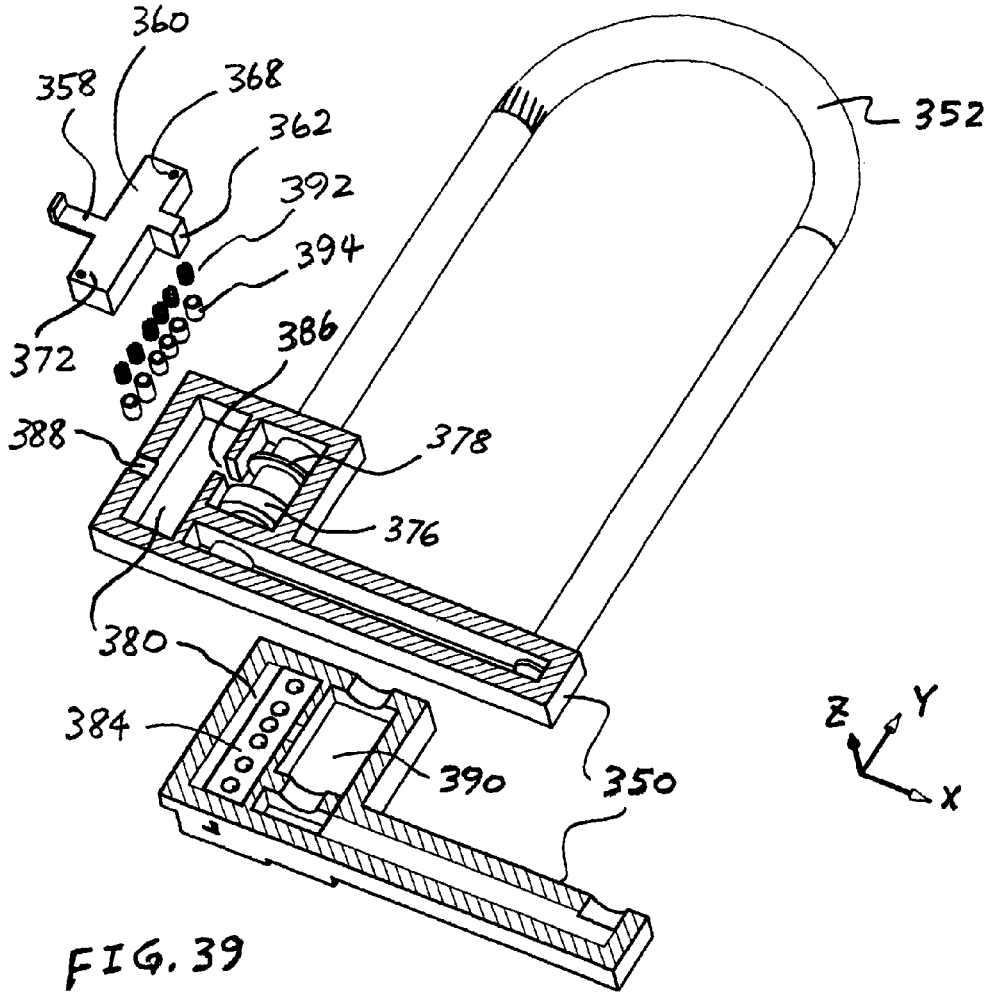
FIG. 39 is an exploded perspective view of the bicycle lock in FIG. 38.

The second lock is also a bicycle lock, but includes a safe activator. Most of its design and operation are similar to those of the first lock, except that the spring mass of this lock can move only in X-axis direction, after applying force to the safe activator. Its design and operation are shown in FIGS. 37 through 45. A perspective view of the lock in locked mode is shown in FIG. 37, having outer shell 350, shackle 352, keyway entrance 354, top cover 356, and safe activator 358. FIG. 38 shows the perspective view of said lock at locked mode, with its top cover 356 removed. FIG. 39 is the exploded view of the embodiment in FIG. 38, being cut in the X-Y plane and separated at the shear surface between spring mass 360 and key mass 384. In FIGS. 38 and 39, the lock has spring mass 360, which is attached rigidly to a stopper 362 and a safe activator 358, acting together as one piece, and a matching key mass 384. The safe activator 358 in this case is a single component, a pull-push handle. The key mass 384 is fitted tightly in the cavity 380 of the outer shell 350. Spring mass 360 rests on top of the key mass 384. The spring mass 360 is movable only in X-axis direction within the confines of the cavity 380, with the stopper 362 sliding at the cutout 386 of the partition between the cavities 380 and 390, and the safe activator 358 sliding at the cutout 388 at the outer shell wall. Safe activator 358 is designed as a sacrificial component intended to break at a certain critical force that is less than a force required to break other internal components of the spring mass. At most, it will only need to withstand enough force to allow the reciprocating movement of stopper 362 into the locked and unlocked positions between the two rings 376 and 378, and it may be designed to break at the application of some additional force beyond said minimal force. In this manner, the spring mass, which is in the lock housing, can be prevented from forced unlocking movement.

Figure 40:
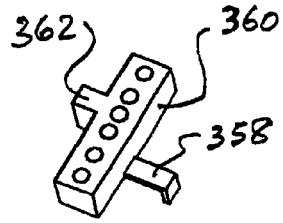
FIG. 40 is the bottom perspective view of one option of the spring mass of FIG. 39.
Figure 41:
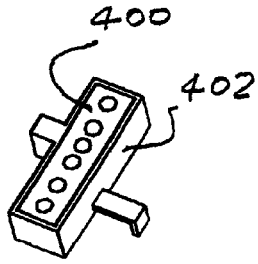
FIG. 41 is the bottom perspective view of another option of the spring mass of FIG. 39.
Figure 42:
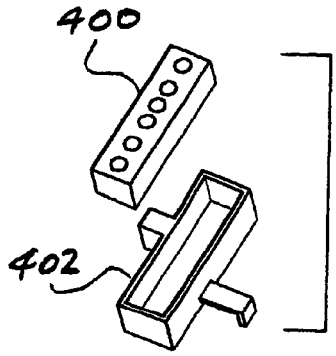
FIG. 42 is the exploded perspective view of the spring mass of FIG. 41.

To show two possible designs of the spring mass 360, in FIG. 39, the spring mass 360 is separated from its springs 392 and spring pins 394. Then, it is rotated up-side-down showing two different constructions as shown in FIGS. 40 and 41. In FIG. 40, the first design of the spring mass 360 shows the stopper 362 and safe activator 358 attached rigidly to the spring mass 360 as one solid piece. In FIG. 41, the second design of the spring mass 360 shows that the spring mass 400 is embedded in a rigid casing 402. FIG. 42 shows an exploded view of FIG. 41.

In locked mode, as shown in FIG. 38, the corner 368 of spring mass 360 is touching and fitting into the corner 370 of cavity 380. The shackle 352 has two rings 376 and 378 attached rigidly apart at a distance slightly wider than the width of the stopper 362 such that the rings 376 and 378 will not clamp on stopper 362 while the shackle 352 is rotating. The shackle 352 is installed in the outer shell 350 in the same manner as the shackle 302 in the outer shell 300 of the last bicycle lock in FIG. 33. In FIG. 38, the section view 43-43 is cut through the outer shell 350 along the X-Z plane at corner 374. Then, as shown in FIG. 43, the outer wall piece 406 is separated and moved away from the remaining part of the lock. FIG. 43 shows the relative locations of the spring mass 360, key mass 384, both ends of the shackle 352, and the partial outer shell 350 in locked mode.

To unlock the lock of FIGS. 38, 43 and 44, a correct key 410 is inserted into the keyway through entrances 354 and 404. With all the spring pins pushed out of the key mass 384 by the correct key, the lock is in unlocked mode. Pulling the safe activator 358 in the negative X-axis direction, the stopper 362 comes out of the space between the rings 376 and 378. The movement of the spring mass 360 stopped when its corner 372 touching the corner 374 of the outer shell 350. Then, the free end of shackle 352 can be pulled out of the hole 412 in outer shell 350. This movement will be stopped, when the ring 378 touching the wall of the outer shell. Now, the shackle 352 is free to rotate; and, the lock is in unlocked mode. The key for this lock is for example a single curvature key, bent on Y-Z plane, as shown in FIG. 45.

To re-lock the lock and retrieve the key 410 out of the lock, in FIGS. 43 and 44, the shackle 352 is urged in negative Y-axis direction, and the free end of the shackle 352 is moved toward the hole 412 on the outer shell 350. The free end of the shackle 352 is then moved back into the hole 412. Next, in FIGS. 38, 39, and 43, the safe activator 358 and stopper 362 are pushed in the positive X-axis direction. The stopper 362 enters the space between the rings 376 and 378, and is then stopped by the shaft of shackle 352. At this point, corner 368 of spring mass 360 reaches corner 370 of cavity 380. All the spring pins in spring mass 360 will then be aligned and touching with the corresponding key pins in key mass 384, with their touching ends disposed at the shear surface. Now, the key 410 can be pulled out of the lock. Without the key bits of key 410 supporting, the springs in the spring mass 360 push the spring pins partially back into the key mass 384. In turn, they push down all the corresponding key pins back to the original positions in the locked mode.

Figure 46:
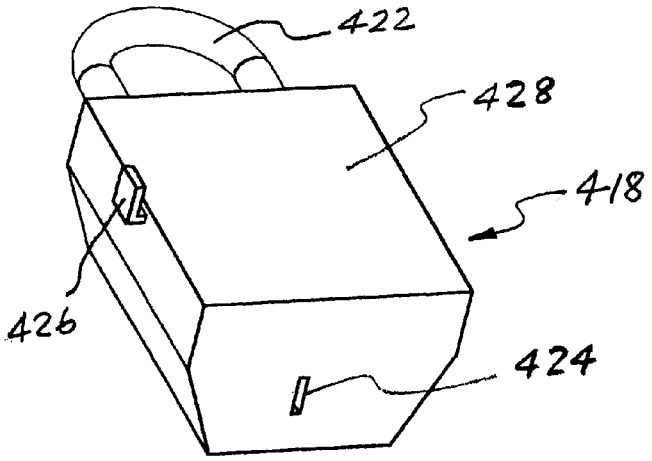
FIG. 46 is a perspective view of a pad lock.
Figure 46:
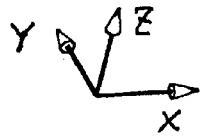
Figure 47:
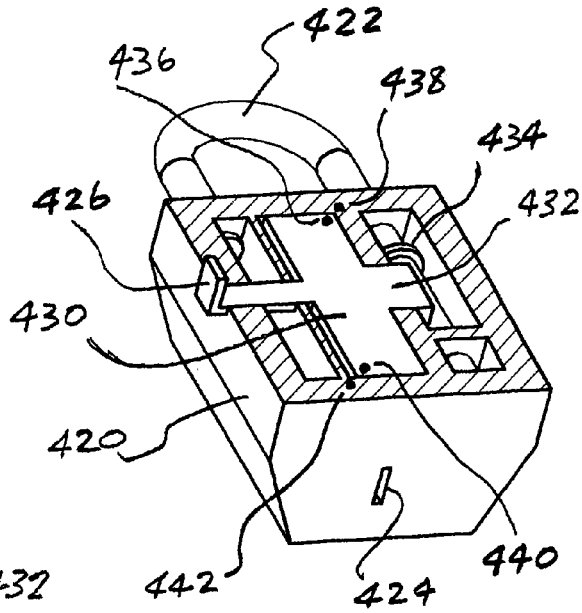
FIG. 47 is a perspective view of the pad lock in FIG. 46 with its top cover removed.
Figure 48:
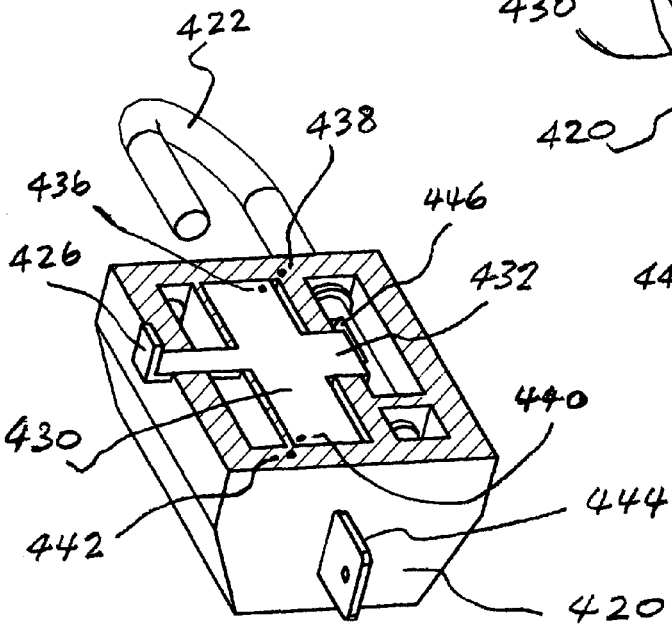
FIG. 48 is a perspective view of the pad lock in FIG. 47, with a correct key inserted, and its shackle unlocked and turned.

The third lock is a padlock 418. Its design and operation are shown in FIGS. 46 through 49. A perspective view of the lock in locked mode is shown in FIG. 46, having outer shell 420, shackle 422, keyway entrance 424, safe activator 426, and top cover 428. A perspective view of the lock in locked mode, with its top cover 428 removed, is shown in FIG. 47. FIG. 49 is the exploded view of the arrangement of FIG. 47. The view is a cut along the X-Y plane, and separated at the shear surface between spring mass 430 and key mass 450 (FIG. 49). FIG. 48 shows the embodiment in unlocked mode with a correct key 444. Most of its design and operation are similar to those of the second lock above. The shackle 422 is restrained by inserting the stopper 432 into the recess 446 on the shaft of shackle 422, shown in FIGS. 47 and 49. The keyway 424 is curved with multi-curvature in the X-Y plane, with the key 444 being made of flexible material. This can be seen, in FIG. 49, from the nonlinear arrangement of the key pin bores 452 on the key mass 450, and the key 444 is straight when it is outside of the lock. In FIGS. 47 and 49, the lock has spring mass 430, integral with which are stopper 432 and a safe activator 426, acting together as one piece. Matching key mass 450 is best illustrated in FIG. 49. The key mass 450 fits snugly in cavity 472 of the outer shell 420. Spring mass 430 rests on key mass 450. The spring mass 430 is movable only in the X-axis direction within the confines of the cavity 474, with the stopper 432 sliding at the cutout 468 of the partition between the cavities 474 and 476, and the safe activator 426 sliding at the cutouts 464 and 466.

In locked mode, as shown in FIGS. 47 and 49, the corner 436 of spring mass 430 is generally abutting the corner 438 of cavity 474. In FIG. 49, the shackle 422 has the ring 434 attached rigidly at the shackle. The shackle has a recess 446, with a width slightly wider than that of the stopper 432; such that the stopper 432 can move freely in and out of the recess 446. The shackle 422 is installed in the outer shell 420 with its free leg inserted into the hole 462 at the farther wall of the outer shell; and, the other leg of the shackle inserted through the holes 458 and 460, until the tip 456 of the shackle stops at the nearer wall of the outer shell.

To unlock the above lock, in FIGS. 47 through 49, a correct key 444 is inserted into keyway through entrance 424. After all the spring pins are pushed out of the key mass 450 by the correct key, the safe activator 426 and the spring mass 430 are pulled in the negative X-axis direction. The stopper 432 comes out of the recess 446 of the shackle 422. This movement of the spring mass 430 is stopped when its corner 440 substantially abuts the corner 442 of the cavity 474 of outer shell 420. Then, the free end of the shackle 422 can be pulled out of the hole 462, until the ring 434 is stopped at the farther wall of the outer shell. The lock is then in unlocked mode, and the shackle 422 is free to rotate.

To re-lock the lock and retrieve the key 444 out of the lock, in FIGS. 47 through 49, the shackle 422 is pushed in negative Y-axis direction, and the free end of the shackle 422 is directed toward the hole 462 on the outer shell 420. When the tip 456 of shackle reaches the interior surface at the nearer wall of outer shell 420, the pushing is stopped. The free end of the shackle 422 is then back in the hole 462. The safe activator 426 and the stopper 432 are then pushed in the positive X-axis direction. The stopper 432 enters the recess 446 on the shaft of shackle 422 and is then stopped by the shaft. At this point, corner 436 of spring mass 430 reaches the corner 438 of cavity 474. All the spring pins in spring mass 430 are aligned and touching with the corresponding key pins in key mass 450, with their touching ends stopped at the shear surface. The key 444 can then be pulled out of the lock. Without the key bits of key 444 supporting, the springs in the spring mass 430 push the spring pins partially back into the key mass 450. In turn, they push down all the corresponding key pins back to the original positions in the locked mode.

Figure 50:
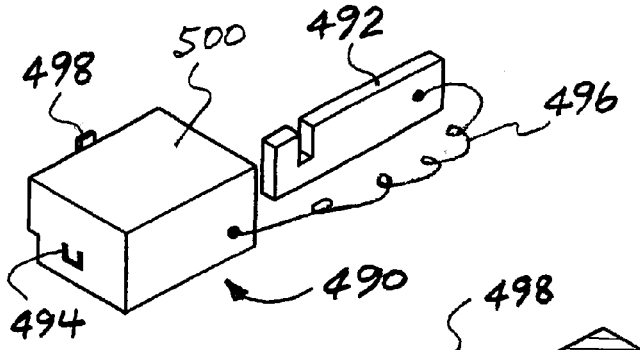
FIG. 50 is a perspective view of an unlocked cable lock.
Figure 51:
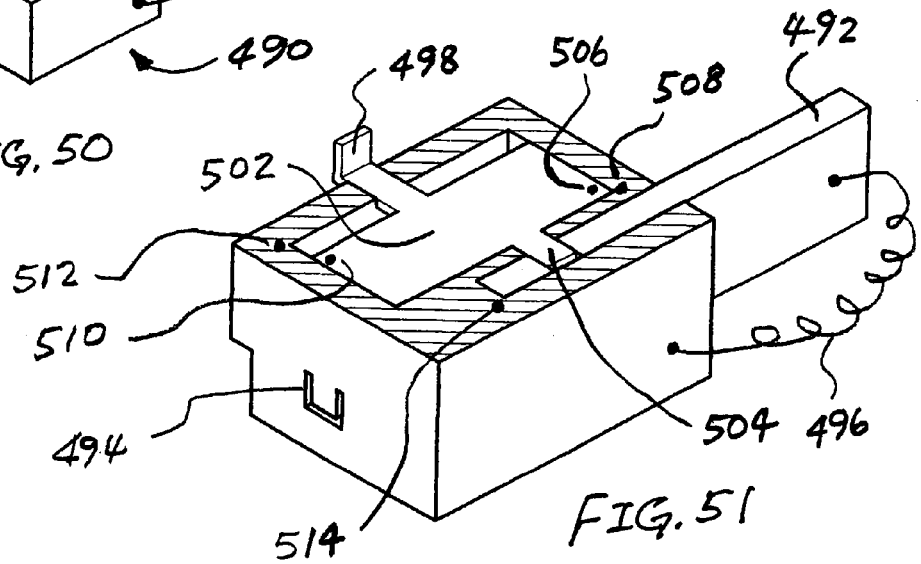
FIG. 51 is the perspective view of an unlocked cable lock, with its top cover removed.
Figure 52:
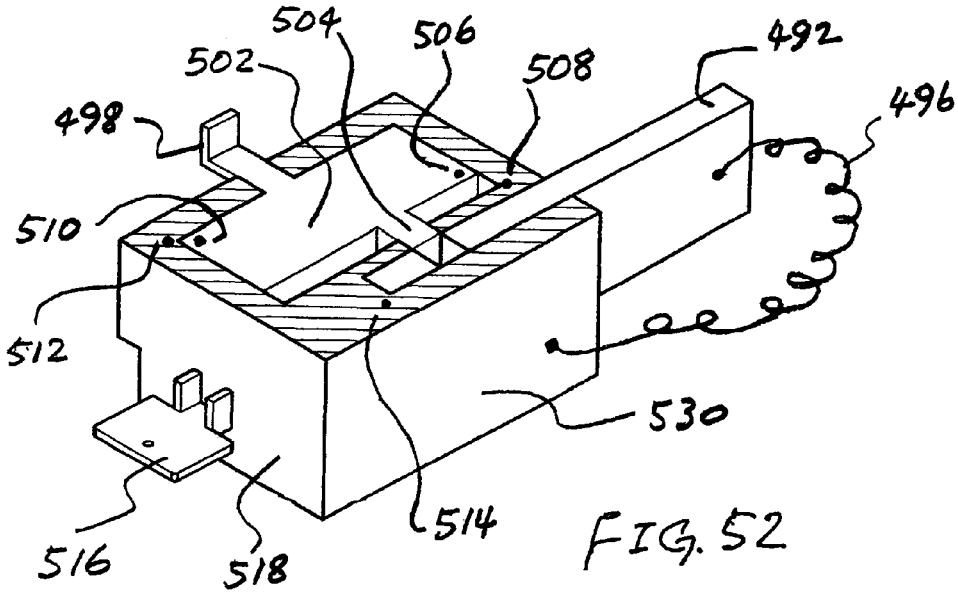
FIG. 52 shows the perspective view of inserting a correct key into the cable lock of FIG. 51.

The fourth lock is a cable lock. Its design and operation are shown in FIGS. 50 through 55. A perspective view of the lock is shown in FIG. 50, having outer shell 490, hook 492, keyway entrance 494, cable 496, safe activator 498 and top cover 500. The hook 492 is connected to the outer shell 490 with the cable 496. FIG. 51 shows the perspective view of the lock with its top cover 500 removed, showing the spring mass 502 and the hook 492 at locked mode. FIG. 52 is the perspective view of the embodiment in FIG. 51, after inserting with the correct key 516 and the spring mass 502 is moved toward the negative X-axis direction to unlock position.

Figure 55:
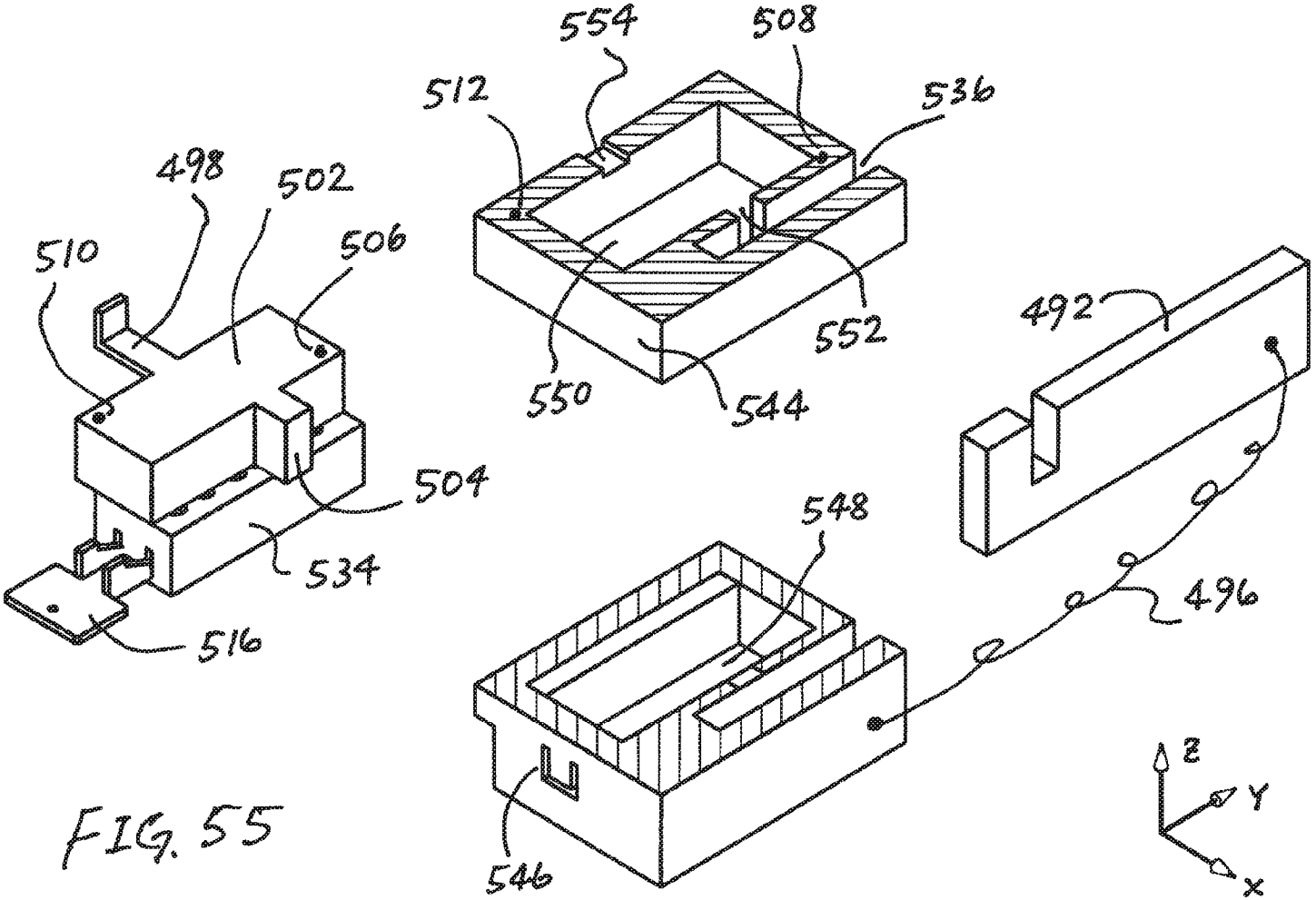
FIG. 55 is an exploded perspective view of the cable lock in FIG. 53.

FIG. 53 is the embodiment in FIG. 52, cut along an X-Z plane at corner 512, and the separated nearer outer wall 518 removed. FIG. 54 is the embodiment in FIG. 53, after being cut along the Y-Z plane at corner 514, and the separated nearer outer wall 530 removed. Also, the key 516 is pulled out of the lock and the hook 492 is placed in the hook chamber 536. The key 516 is a compound key which has two rows of bit flanges 540 and 542. FIG. 55 is the exploded view of the embodiment in FIG. 52, being cut in the X-Y plane and separated at the shear surface between spring mass 502 and key mass 534. The partial outer shell is divided into two parts 544 and 546. In FIGS. 51 through 55, the lock has spring mass 502, which is attached rigidly with a stopper 504 and a safe activator 498, acting together as one piece; and a matching key mass 534. The stopper 504 can be inserted into and pulled out of the opening of the hook 492 easily. The key mass 534 is fitted tightly in the cavity 548 of the partial outer shell 546. In FIG. 55, spring mass 502 rests on key mass 534. The spring mass 502 is movable only in the X-axis direction within the confines of the cavity 550; with the stopper 504 sliding at the cutout 552 of the partition between the cavities 550 and the hook chamber 536, and the safe activator 498 sliding at the cutout 554 at the farther outer shell wall.

In locked mode, as shown in FIGS. 51 and 55, the corner 506 of spring mass 502 is touching and fitted into the corner 508 of cavity 550. Also, the hook 492 is inserted into the hook chamber 536 to engage stopper 504.

To unlock the embodiment, in FIGS. 52 and 53, a correct key 516 is inserted into the keyway through entrance 494. After all the spring pins pushed out of the key mass 534 by the correct key, the safe activator 498 and the spring mass 502 can be pulled in the negative X-axis direction. Then, the stopper 504 is disengaged from the hook 492. This movement of the spring mass 502 is stopped when its corner 510 reaches the corner 512 of the outer shell wall 518. The hook 492 can then be pulled out from the hook chamber to unlock the lock.

To retrieve the key 516 out of the lock, in FIGS. 53 through 55, the safe activator 498 is pushed in positive X-axis direction, until the corner 506 of spring mass 502 reaches corner 508 of cavity 550. Then all the spring pins in spring mass 502 are aligned and touching with the corresponding key pins in key mass 534, with their touching ends stopping at the shear surface. Now, the key 516 can be pulled out of the lock. Without the key bits of key 516 supporting, the springs in the spring mass 502 push the spring pins partially back into the key mass 534. In turn, they push down all the corresponding key pins back to the original positions in the locked mode. In FIG. 54, the hook 492 is inserted in the hook chamber 536 to return back to the locked mode of FIG. 51. However, it is not necessary to insert the hook to retrieve the key.

The second through fourth locks above have spring masses that move in the x-direction as drawn, and are particularly amenable to the use of a sandwich construction as explained above.

As previously explained, one of the advantages of the MMLS lock system as described herein is that little or no force is transmitted through the key to perform the unlocking. The key can thus merely serve an authenticating purpose rather than as a conduit for force required to do the actual unlocking. In other words, the path of the unlocking force is not through the key itself but is independent thereof. The key is inserted in the lock, and then a force is applied to the spring mass, not by way of the key, to perform the unlocking.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted except in the spirit of the appended claims.

What is claimed is:

1. A lock comprising:

a lock body;

a key;

a key mass rigidly coupled to the lock body, the key mass including a first key mass bore, a keyway in communication with the first key mass bore and having a hole into which the key is insertable, and at least first and second key mass segments arranged one behind the other along the keyway such that a key inserted in the hole of the keyway passes sequentially into the first and second key mass segments;

a spring mass movable relative to the key mass, the spring mass including a first spring mass bore;

a stopper coupled to the spring mass and movable thereby between a locked position and an unlocked position of the lock;

a first key mass pin mounted for reciprocation in the first key mass bore; and a first spring mass pin mounted for reciprocation in the first spring mass bore, wherein the keyway is configured to receive the key first through the first key mass segment and then into the second key mass segment, the received key being operable to motivate the first key mass pin between first and second positions corresponding respectively to the locked and unlocked positions of the lock, at least one of the first spring mass pin or first key mass pin interfering with the relative motion in the first position and not interfering with the relative motion in the second position, and wherein the first and second key mass segments are either unattached to one another or attached to one another sufficiently weakly such that a force applied to the first key mass segment capable of breaking one or more key mass bins or spring mass pins is not transferred to the second key mass segment.

2. The lock of claim 1, wherein relative motion between the spring mass and the key mass is along a non-cylindrical surface or only a partially cylindrical surface.

3. The lock of claim 1, wherein relative motion between the spring mass and the key mass is along one or more plane shear surfaces.

4. The lock of claim 1, wherein the keyway and key have L-shaped cross sections.

5. The lock of claim 1, wherein the key mass includes one or more additional key mass bores in communication with the keyway, and the spring mass includes one or more additional spring mass bores, the lock further comprising:

one or more additional key mass pins each mounted for reciprocation in a corresponding one of the one or more additional key mass bores; and one or more additional spring mass pins each mounted for reciprocation in a corresponding one of the one or more additional spring mass bores.

6. The lock of claim 1, wherein the spring mass includes a safe activator for receiving force from an operator for moving the spring mass relative to the key mass, the safe activator being configured to fail with the application of a push-pull force that is greater, by a prescribed margin, than the force required to move the spring mass during normal operation.

7. The lock of claim 1, said lock being a bicycle lock.

8. The lock of claim 1, wherein at least one of the key mass or spring mass is made of hardened steel.

9. The lock of claim 1, wherein at least one of the key mass or spring mass is made of stainless steel.

10. The lock of claim 5, wherein at least one of the one or more additional key mass bores is disposed in a different segment of the key mass from the first key mass bore.

11. The lock of claim 5, wherein at least one of the one or more additional spring mass bores is disposed in a different segment of the spring mass from the first spring mass bore.

12. A lock comprising:

a key;

a stationary key mass including a first key mass bore, at least first and second key mass segments, and a keyway in communication with the first key mass bore, the keyway passing through at least one of the first and second key mass segments and being configured to receive the key first through the first key mass segment and then into the second key mass segment;

a movable spring mass including a first spring mass bore;

a first spring mass pin mounted for reciprocation in the first spring mass bore;

a first key mass pin mounted for reciprocation in the first key mass bore between a locked position in which the spring mass is immobilized and an unlocked position in which spring mass motion is unconstrained in at least one direction, wherein the unlocked position is a function of the presence of the key in the keyway, wherein the first and second key mass segments are either unattached to one another or attached to one another sufficiently weakly such that a force applied to the first key mass segment capable of breaking one or more key mass bins or spring mass pins is not transferred to the second key mass segment.

13. The lock of claim 12, wherein motion of the spring mass is non-rotational.

14. The lock of claim 12, wherein motion of the spring mass is rotational in a plane.

15. The lock of claim 12, wherein the keyway and key have L-shaped cross sections.

16. The lock of claim 12, wherein the key mass includes one or more additional key mass bores in communication with the keyway, and the spring mass includes one or more additional spring mass bores, the lock further comprising:

one or more additional key mass pins each mounted for reciprocation in a corresponding one of the one or more additional key mass bores; and one or more additional spring mass pins each mounted for reciprocation in a corresponding one of the one or more additional spring mass bores.

17. The lock of claim 12, wherein the spring mass includes a safe activator for receiving force from an operator for moving the spring mass, the safe activator being configured to fail with the application of push-pull force that is greater, by a prescribed margin, than the force required to move the spring mass during normal operation.

18. The lock of claim 12, wherein the at least two segments have different melting points.

19. The lock of claim 12, said lock being a bicycle lock.

20. The lock of claim 12, wherein at least one of the key mass or spring mass is made of hardened steel.

21. The lock of claim 12, wherein at least one of the key mass or spring mass is made of stainless steel.

22. The lock of claim 16, wherein at least one of the one or more additional key mass bores is disposed in a different segment of the key mass from the first key mass bore.

23. The lock of claim 16, wherein at least one of the one or more additional spring mass bores is disposed in a different segment of the spring mass from the first spring mass bore.

24. The lock of claim 16, wherein the key mass includes one or more additional key mass bores in communication with the keyway, and the spring mass includes one or more additional spring mass bores, the lock further comprising:

one or more additional key mass pins each mounted for reciprocation in a corresponding one of the one or more additional key mass bores; and one or more additional spring mass pins each mounted for reciprocation in a corresponding one of the one or more additional spring mass bores, and wherein at least one of the one or more additional spring mass bores is disposed in a different segment of the spring mass from the first spring mass bore.

25. A lock comprising:

a key;

a key mass including at least first and second key mass segments, the key mass having a keyway for receiving the key, the keyway passing through at least one of the first and second key mass segments; and a spring mass that is movable from a first position to a second position when the key is inserted in the keyway using an insertion force and when an unlocking force is applied to the lock, the first and second positions corresponding to a locked state and an unlocked state of the lock, respectively, wherein the unlocking force is applied along a force path that is independent of a path of the insertion force, and wherein the first and second key mass segments are either unattached to one another or attached to one another sufficiently weakly such that a force applied to the first key mass segment capable of breaking one or more key mass bins or spring mass pins is not transferred to the second key mass segment.

26. The lock of claim 25, wherein motion of the spring mass is relative to the key mass and is along a non-cylindrical surface or only a partially cylindrical surface.

27. The lock of claim 25, wherein motion of the spring mass is relative to the key mass and is along one or more plane shear surfaces.

28. The lock of claim 25, wherein the keyway and key have L-shaped cross sections.

29. The lock of claim 25, wherein the spring mass includes a safe activator for receiving the unlocking force, the safe activator being configured to fail with the application of a push-pull force that is greater, by a prescribed margin, than the force required to move the spring mass during normal operation.

30. The lock of claim 25, wherein the at least two segments have different melting points.

31. The lock of claim 25, said lock being a bicycle lock.

32. The lock of claim 25, wherein at least one of the key mass or spring mass is made of hardened steel.

33. The lock of claim 25, wherein at least one of the key mass or spring mass is made of stainless steel.

34. The lock of claim 25, wherein the key mass includes one or more additional key mass bores in communication with the keyway, and the spring mass includes one or more additional spring mass bores, the lock further comprising:

one or more additional key mass pins each mounted for reciprocation in a corresponding one of the one or more additional key mass bores; and one or more additional spring mass pins each mounted for reciprocation in a corresponding one of the one or more additional spring mass bores, and wherein at least one of the one or more additional key mass bores is disposed in a different segment of the key mass from the first key mass bore.

* * * * *